US005985182A

United States Patent [19]

Zhao

[11] Patent Number: 5,985,182

[45] Date of Patent: Nov. 16, 1999

[54] HIGH TEMPERATURE PTC DEVICE AND CONDUCTIVE POLYMER COMPOSITION

[75] Inventor: Liren Zhao, Mansfield, Ohio

[73] Assignee: Therm-O-Disc, Incorporated, Mansfield, Ohio

[21] Appl. No.: 09/046,853

[22] Filed: Mar. 24, 1998

Related U.S. Application Data

[63] Continuation-in-part of application No. 08/729,822, Oct. 8, 1996, Pat. No. 5,837,164.

[51] Int. Cl.[6] ..... H01B 1/24; H01C 7/02

[52] U.S. Cl. ..... 252/511; 338/20; 338/21

[58] Field of Search ..... 252/511; 338/20, 338/21; 219/209

[56] References Cited

U.S. PATENT DOCUMENTS

| | | | |
|---|---|---|---|
| 4,237,441 | 12/1980 | van Konynenburg et al. | 338/22 |
| 4,238,812 | 12/1980 | Middleman et al. | 361/106 |
| 4,304,987 | 12/1981 | van Konynenburg | 219/553 |
| 4,329,726 | 5/1982 | Middleman et al. | 361/158 |
| 4,420,534 | 12/1983 | Matsui et al. | 428/372 |
| 4,457,973 | 7/1984 | Matsui et al. | 428/372 |
| 4,545,926 | 10/1985 | Fouts, Jr. et al. | 252/511 |
| 4,559,112 | 12/1985 | Tamamura et al. | 204/12 |
| 4,575,620 | 3/1986 | Ishii et al. | 219/549 |
| 4,591,700 | 5/1986 | Sopory | 219/505 |
| 4,624,990 | 11/1986 | Lunk et al. | 525/199 |
| 4,636,331 | 1/1987 | Sako et al. | 252/511 |
| 4,658,121 | 4/1987 | Horsma et al. | 219/553 |
| 4,698,488 | 10/1987 | Kishimoto | 219/549 |
| 4,700,054 | 10/1987 | Triplett et al. | 219/549 |
| 4,742,212 | 5/1988 | Ishii et al. | 219/549 |
| 4,775,778 | 10/1988 | van Konynenburg et al. | 219/549 |
| 4,849,133 | 7/1989 | Yoshida et al. | 254/511 |
| 4,859,836 | 8/1989 | Lunk et al. | 219/548 |
| 4,902,562 | 2/1990 | Bahia | 428/483 |
| 4,910,389 | 3/1990 | Sherman et al. | 219/548 |
| 4,954,695 | 9/1990 | Smith-Johannsen et al. | 219/548 |
| 5,039,844 | 8/1991 | Nagahori | 219/541 |
| 5,049,850 | 9/1991 | Evans | 338/22 |

(List continued on next page.)

FOREIGN PATENT DOCUMENTS

| | | |
|---|---|---|
| 929 350 | 6/1955 | Germany . |
| 63-302501 | 4/1988 | Japan . |

OTHER PUBLICATIONS

Narkis, M,.A. Ram and Z. Stein. Electrical Properties of Carbon Black Filled Crosslinked Polyethylene. Polymer Engineering and Science vol. 21 (16): 1049–1054, Nov. 1981.

Sherman, R.D., L. M. Middleman and S.M. Jacobs. Electron Transport Processes in Conductor–Filled Polymers. Polymer Engineering and Science vol. 23 (1):36–46, Jan., 1983.

Kulwicki, Bernard M. Trends in PTC Resistor Technology. Sample J. (Nov./Dec. 1987): 34–38.

(List continued on next page.)

*Primary Examiner*—Mark Kopec

*Attorney, Agent, or Firm*—Harness, Dickey & Pierce, P.L.C.

[57] ABSTRACT

A high temperature PTC device comprising a polymeric conductive composition that includes nylon-11 and a carbon-based particulate conductive filler has a switching temperature greater than 150° C., preferably between about 160° C. and 200° C. The composition demonstrates a high PTC effect (at least $10^3$, and more typically $10^4$ to $10^5$ or greater) and a resistivity at 25° C. of 100 Ωcm or less, preferably 10 Ωcm or less. High temperature PTC devices that comprise nylon-11 or nylon-12 compositions and that are manufactured by extrusion/lamination demonstrate good thermal and electrical stability compared with those manufactured by compression molding and do not require composition crosslinking for stability, although crosslinking may be used to further improve stability. The use of a high temperature solder for attaching electrical terminals to the device improves the PTC properties of the device.

57 Claims, 7 Drawing Sheets

U.S. PATENT DOCUMENTS

| | | | |
|---|---|---|---|
| 5,093,898 | 3/1992 | van Konynenburg et al. | 392/451 |
| 5,143,649 | 9/1992 | Blackledge et al. | 252/54 |
| 5,164,133 | 11/1992 | Ishida et al. | 264/105 |
| 5,174,924 | 12/1992 | Yamada et al. | 252/511 |
| 5,178,797 | 1/1993 | Evans | 252/508 |
| 5,227,946 | 7/1993 | Jacobs et al. | 361/106 |
| 5,231,371 | 7/1993 | Kobayashi | 338/22 |
| 5,232,631 | 8/1993 | Cao et al. | 252/500 |
| 5,246,627 | 9/1993 | Heeger et al. | 252/500 |
| 5,250,226 | 10/1993 | Oswal | 252/500 |
| 5,250,228 | 10/1993 | Baigrie et al. | 252/511 |
| 5,254,633 | 10/1993 | Han et al. | 525/327.4 |
| 5,317,061 | 5/1994 | Chu et al. | 525/200 |
| 5,318,845 | 6/1994 | Tanaka et al. | 428/373 |
| 5,340,499 | 8/1994 | Kärnä et al. | 252/500 |
| 5,378,407 | 1/1995 | Chandler et al. | 252/513 |
| 5,382,384 | 1/1995 | Baigrie et al. | 252/511 |
| 5,422,462 | 6/1995 | Kishimoto | 219/545 |
| 5,427,855 | 6/1995 | Heeger et al. | 428/401 |
| 5,451,919 | 9/1995 | Chu et al. | 338/22 R |
| 5,491,027 | 2/1996 | Heeger et al. | 428/401 |
| 5,498,372 | 3/1996 | Hedges | 252/511 |

OTHER PUBLICATIONS

Shrout, T.R., D. Moffatt, W. Huebner. Composite PTCR thermistors utilizing conducting borides, silicides, and carbide powders. J. Material Sci. 26 (1991): 145–154. (No month).

Ki Hyun Yoon, Yun Woo Nam. Positive temperature coefficient of resistance effects in $BaPbO_3$/polyethylene composites. J. Material Sci. 27 (1992): 4051–4055.

Wentao Jia and Xinfang Chen. PTC Effect of Polymer Blends Filled with Carbon Black. J. Appl. Polym. Sci. 54 (1994): 1219–1221.

Kozake, K., M. Kawaguchi, K. Sato, M. Kuwabara. $BaTiO_3$–based positive temperature coefficient of resistivity ceramics with low Reistivities prepared by the oxalate method. J. Materal Sci. 30 (1995): 3395–3400.

Huybrechts, B., K. Ishizaki, M. Takata. Review: The positive temperature coefficient of resistivity in barium titanate. J. Material Sci. 30 (1995): 2463–2474.

HIGH TEMPERATURE PTC DEVICE AND CONDUCTIVE POLYMER COMPOSITION

This application is a continuation-in-part of U.S. patent application, Ser. No. 08/729,822, filed Oct. 8, 1996 now U.S. Pat. No. 5,837,164.

BACKGROUND OF THE INVENTION

Electrical devices comprising conductive polymeric compositions that exhibit a positive temperature coefficient (PTC) effect are well known in electronic industries and have many applications, including their use as constant temperature heaters, thermal sensors, over current regulators and low-power circuit protectors. A typical conductive polymeric PTC composition comprises a matrix of a crystalline or semi-crystalline thermoplastic resin (i., polyethylene) or an amorphous thermoset resin (e.g., epoxy resin) containing a dispersion of a conductive filler, such as carbon black, graphite chopped fibers, nickel particles or silver flakes. Some compositions additionally contain non-conductive fillers, such as metal oxides, flame retardants, stabilizers, antioxidants, antiozonants, crosslinking agents and dispersing agents.

At a low temperature (e.g. room temperature), the polymeric PTC composition has a compact structure and resistivity property that provides low resistance to the passage of an electrical current. However, when a PTC device comprising the composition is heated or an over current causes the device to self-heat to a transition temperature, a less ordered polymer structure resulting from a large thermal expansion presents a high resistivity. In electrical PTC devices, for example, this high resistivity limits the load current, leading to circuit shut off. In the context of this invention, $T_S$ is used to denote the "switching" temperature at which the "PTC effect" (a rapid increase in resistivity) takes place. The sharpness of the resistivity change as plotted on a resistance versus temperature curve is denoted as "squareness", i.e., the more vertical the curve at the $T_S$, the smaller is the temperature range over which the resistivity changes from the low to the maximum values. When the device is cooled to the low temperature value, the resistivity will theoretically return to its previous value. However, in practice, the low-temperature resistivity of the polymeric PTC composition may progressively increase as the number of low-high-low temperature cycles increases, an electrical instability effect known as "ratcheting". Crosslinking of a conductive polymer by chemicals or irradiation, or the addition of inorganic fillers or organic additives are usually employed to improve electrical stability.

In the preparation of the conductive PTC polymeric compositions, the processing temperature often exceeds the melting point of the polymer by 20° C. or more, with the result that the polymers may undergo some decomposition or oxidation during the forming process. In addition, some devices exhibit thermal instability at high temperatures and/or high voltages that may result in aging of the polymer. Thus, inorganic fillers and/or antioxidants, etc. may be employed to provide thermal stability.

One of the applications for PTC electrical devices is a self-resettable fuse to protect equipment from damage caused by an over-temperature or over-current surge. Currently available polymeric PTC devices for this type of application are based on conductive materials, such as carbon black filled polyethylene, that have a low $T_S$, i.e. usually less than 125° C. However, for some applications, e.g. circuit protection of components in the engine compartment or other locations of automobiles, it is necessary that the PTC composition be capable of withstanding ambient temperatures as high as about 120° C. to 130° C., without changing substantially in resistivity. Thus, for these applications, the use of such a carbon black filled polyethylene-based or similar device is inappropriate. Recent interest in polymeric PTC materials, therefore, has focused on selection of a polymer, copolymer or polymer blend that has a higher and sharper melting point, suitable for comprising a high temperature polymeric PTC composition (i.e. a composition having a $T_S$ higher than 125° C.).

For many circuits, it is also necessary that the PTC device have a very low resistance in order to minimize the impact of the device on the total circuit resistance during normal circuit operation. As a result, it is desirable for the PTC composition comprising the device to have a low resistivity, i.e. 10 ohm-cm (Ωcm) or less, which allows preparation of relatively small, low resistance PTC devices. There is also a demand for protection circuit devices that not only have low resistance but show a high PTC effect (i.e. at least 3 orders of magnitude in resistivity change at $T_S$) resulting in their ability to withstand high power supply voltages. In comparison with low $T_S$ materials, some high temperature polymeric PTC compositions have been shown to exhibit a PTC effect of up to $10^4$ or more. High temperature polymeric PTC compositions also theoretically have more rapid switching times than low $T_S$ compositions, (i.e. the time required to reduce the electrical current to 50 percent of its initial value at the $T_S$), even at low ambient temperatures. Thus, PTC devices comprising high temperature polymeric PTC materials are desirable because they may be expected to have better performance than low temperature polymeric PTC devices, and also be less dependent on the ambient operating temperature of the application.

High temperature polymeric PTC materials such as homopolymers and copolymers of poly(tetrafluorethylene), poly(hexafluoropropylene) and poly(vinylidene fluoride) (PVDF), or their copolymers and terpolymers with, for example, ethylene or perfluorinated-butyl ethylene, have been investigated as substitutes for polyethylene-based materials to achieve a higher $T_S$. Some of these compositions exhibited a $T_S$ as high as 160–300° C. and a resistivity change at $T_S$ of up to four orders of magnitude ($10^4$) or more. However, thermal instability and the potential for release of significant amounts of toxic and corrosive hydrogen fluoride if overheating occurs, has restricted these materials from practical consideration for high temperature applications.

A variety of other polymers have been tested to explore PTC characteristics. These polymers include polypropylene, polyvinylchloride, polybutylene, polystyrene, polyamides (such as nylon 6, nylon 8, nylon 6,6, nylon 6,10 and nylon 11), polyacetal, polycarbonate and thermoplastic polyesters, such as poly(butylene terephthalate) and poly(ethylene terephthalate). Under the conditions reported, none of these polymers exhibited a useful high temperature PTC effect with a low resistivity state of 10 Ωcm or less. However, it has been reported that the PTC characteristics of certain crystalline polymers, such as polyethylene, polypropylene, nylon-11, and the like, may be improved if they are filled with electrically conducting inorganic short fibers coated with a metal.

More recently, a novel high temperature polymeric PTC composition comprising a polymer matrix of an amorphous thermoplastic resin (crystallinity less than 15%) and a thermosetting resin (e.g. epoxy) has been described. Because the selected thermoplastic resin and thermoset resin were mutually soluble, the processing temperature was substantially low and depended on the curing temperature of the thermoset resin. The use of a thermoset resin apparently assured sufficient crosslinking and no further crosslinking was employed. However, electrical instability (ratcheting) was still a problem with these compositions.

For the foregoing reasons, there is a need for the development of alternative polymeric PTC compositions, and PTC devices comprising them, that exhibit a high PTC effect at a high $T_S$, have a low initial resistivity, are capable of withstanding high voltages, and exhibit substantial electrical and thermal stability.

In our copending U.S. patent application Ser. No. 08/729,822, filed Oct. 8, 1996, we disclose a high temperature PTC composition and device comprising nylon-12 and a particulate conductive filler such as carbon black, graphite, metal particles and the like. The composition demonstrates PTC behavior at a $T_S$ greater than 125° C., typically between 140° and 200° C., more typically between 150° C. and 190° C., a high PTC effect (a maximum resistivity that is at least $10^3$ higher than the resistivity at 25° C.), and a low initial resistivity at 25° C. of 100 Ωcm or less (preferably 10 Ωcm or less). The entire disclosure of the copending application is hereby incorporated by reference.

SUMMARY OF THE INVENTION

The present invention provides a high temperature PTC composition comprising (i) a semicrystalline polymer component that includes nylon-11; and (ii) a carbon-based particulate conductive filler, such as carbon black or graphite or mixtures of these. The nylon-11 composition demonstrates PTC behavior at a $T_S$ greater than 150° C., typically between about 160° C. and about 200° C., more typically between about 165° C. and about 195° C., and most typically between about 170° C. and about 190° C. The composition demonstrates a high PTC effect (at least $10^3$, and more typically $10^4$ to $10^5$ or greater) and a resistivity at 25° C. of 100 Ωcm or less, preferably 10 Ωcm or less.

The semicrystalline polymer component of the composition may also comprise a polymer blend containing, in addition to the first polymer, 0.5%–20% by volume of one or more additional semicrystalline polymers. Preferably, the additional polymer(s) comprise(s) a polyolefin-based or polyester-based thermoplastic elastomer, or mixtures of these.

The invention also provides an electrical device that comprises the nylon-11 containing composition of the present invention or the nylon-12-containing composition of the copending application Ser. No. 081729,822, and exhibits high temperature PTC behavior. The device has at least two electrodes which are in electrical contact with the composition to allow an electrical current to pass through the composition under an applied voltage, which may be as high as 100 volts or more. Electrical terminal(s) are preferably soldered to the electrode(s) with a high temperature solder having a melting temperature at least 10° C. above the $T_S$ of the composition (e.g., a melting point of about 180° C. or greater, 220° C. or greater, 230° C. or greater, or 245° C. or greater).

The device preferably has an initial resistance at 25° C. of less than 100 mΩ, such as about 10 mΩ to about 100 mΩ, but typically 80 mΩ or less, and more typically 60 mΩ or less.

For use in an electrical PTC device, the nylon-11 or nylon-12-containing compositions may be crosslinked by chemical means or irradiation to enhance electrical stability and may further contain an inorganic filler and/or an antioxidant to enhance electrical and/or thermal stability. Crosslinking of the composition is preferred for devices that are manufactured by compression molding. However, it has been discovered herein that manufacture of the electrical PTC device by extrusion in combination with lamination of the electrodes, in contrast to its manufacture by compression molding, produces a device that shows excellent electrical stability without the necessity of crosslinking of the composition, although crosslinking may further increase the electrical stability.

The electrical PTC devices of the invention demonstrate a resistance after 1000 temperature cycles, more preferably 3000 cycles, to the $T_S$ and back to 25° C., that is less than five times, preferably less than three times, more preferably less than twice, and most preferably less than 1.3 times the initial resistance at 25° C.

DETAILED DESCRIPTION OF THE INVENTION

Figure 1:
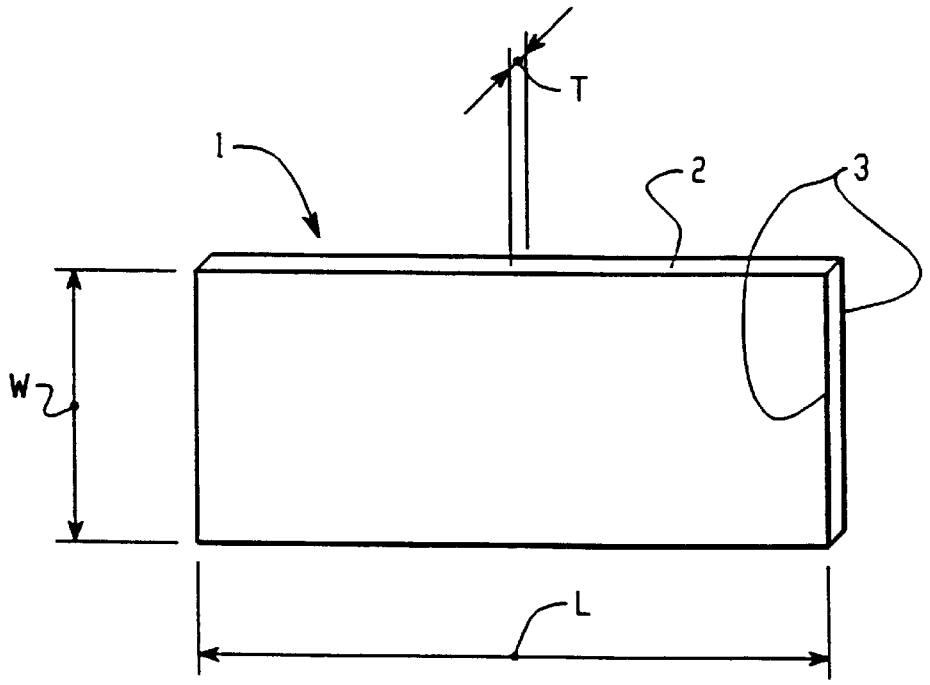
FIG. 1 is a schematic illustration of a PTC chip comprising the polymeric PTC composition of the invention sandwiched between two metal electrodes.

The high temperature polymeric PTC device of the present invention comprises a conductive polymeric composition that comprises (i) a semicrystalline polymer component that includes nylon-12 or nylon-11, and (ii) a particulate conductive filler. As illustrated in the Figures and discussed further below, the nylon-12-containing composition demonstrates PTC behavior at a $T_S$ greater than 125° C., preferably between 140° C. and 200° C., and more preferably, between 150° C. and 190° C. When the composition includes nylon-12, the conductive filler may comprise carbon black, graphite, metal particles, or a combination of these. When the composition includes nylon-11, the conductive filler is preferably a carbon-based filler such as carbon black or graphite or mixtures of these, and the composition demonstrates PTC behavior at a $T_S$ greater than 150° C., including about 155° C., but typically between about 160° C. and about 200° C., more typically between about 165° C. and about 195° C., and most typically between about 170° C. and about 190° C.

The conductive polymeric compositions of the invention also demonstrate a high PTC effect, i.e. the maximum resistivity, as plotted on a resistivity versus temperature curve, is preferably greater than $10^4$ times, but is at least $10^3$ times, greater than the initial resistivity at 25° C. The preferred polymeric composition exhibits an initial resistivity of 100 Ωcm or less at 25° C., and more preferably 10 Ωcm or less, thus providing for a PTC device having a low resistance of about 100 mΩ or less, preferably about 80 mΩ or less, more preferably about 60 mΩ or less, with an appropriate geometric design and size, as discussed further below.

In addition to nylon-12, or nylon-11 or a mixture or copolymer thereof, the conductive polymeric composition may comprise a polymer blend of nylon-12 and/or nylon-11 with another semicrystalline polymer, preferably a polyolefin-based or polyester-based thermoplastic elastomer.

It is known that the $T_S$ of a conductive polymeric composition is generally slightly below the melting point ($T_m$) of the polymeric matrix. Therefore, theory predicts that a polymeric PTC composition may exhibit a high $T_S$ if the melting point of the polymer is sufficiently high. If the thermal expansion coefficient of the polymer is also sufficiently high near the $T_m$, a high PTC effect may also occur. Further, it is known that the greater the crystallinity of the polymer, the smaller the temperature range over which the rapid rise in resistivity occurs. Thus, crystalline polymers exhibit more "squareness", or electrical stability, in a resistivity versus temperature curve.

The preferred semicrystalline polymer component in the conductive polymeric composition of the present invention has a crystallinity in the range of 20% to 70%, and preferably 25% to 60%. In order to achieve a composition with a high $T_S$ and a high PTC effect, it is preferable that the semicrystalline polymer has a melting point ($T_m$) in the temperature range of 150° C. to 200° C., preferably 160° to 195° C., and a high thermal expansion coefficient value at a temperature in the range $T_m$ to $T_m$ minus 10° C. that is at least three times greater than the thermal expansion coefficient value at 25° C. Preferably, the polymer substantially withstands decomposition at a processing temperature that is at least 20° C. and preferably less than 120° C. above the $T_m$.

A suitable first polymer for use in the invention comprises nylon-12 obtained from Elf Atochem North America, Inc., Philadelphia, Pa., or EMS American Grilon, Inc., Sumter, S.C., or Hüils America Inc., Somerset, N.J., with the commercial names of Aesno-TL, Grilamid L20G, Vestamid L1940 and Vestamid L2140, respectively. A nylon-11 polymer suitable for use in the invention may be obtained from Elf Atochem North America, Inc., with the commercial name of Besno-TL. Each of the nylon polymers has a crystallinity of 25% or greater and a $T_m$ of 170° C. or greater. Examples of the thermal expansion coefficients (y) of these polymers at 25° C. and within a range of $T_m$ to $T_m$ minus 10° C. is given in Table 1.

The semicrystalline polymer component of the composition may also comprise a polymer blend containing, in addition to the first polymer, 0.5%–20% by volume of a second semicrystalline polymer. Preferably, the second semicrystalline polymer comprises a polyolefin-based or polyester-based thermoplastic elastomer. The thermoplastic elastomer preferably has a $T_m$ in the range of 150° C. to 190° C. and a thermal expansion coefficient value at a temperature in the range $T_m$ to $T_m$ minus 10° C. that is at least five times greater than the thermal expansion

TABLE 1

| Polymer | Aesno-TL (Nylon-12) | Grilamid L20G (Nylon-12) | Santoprene [TPE†(poly-olefin-based] | Hytrel-G4074 [TPE (poly-ester-based] |
|---|---|---|---|---|
| γ* at 25° C. (cm/cm ° C.) | $1.1 \times 10^{-4}$ | $1.2 \times 10^{-4}$ | $2.8 \times 10^{-4}$ | $1.8 \times 10^{-4}$ |
| γ near $T_m$** (cm/cm ° C.) | $5.5 \times 10^{-4}$ | $4.9 \times 10^{-4}$ | $9.2 \times 10^{-4}$ | $30.9 \times 10^{-4}$ |

*Thermal Expansion Coefficients (γ) were measured with a Thermo Mechanical Analyzer.
**Within the range $T_m$ to $T_m$ minus 10° C.
†Thermoplastic Elastomer.

coefficient value at 25° C. Suitable thermoplastic elastomers for forming a polymer blend with nylon-12 and/or nylon-11 are polyolefin-based or polyester-based and obtained from Advanced Elastomer Systems, Akron, Ohio and DuPont Engineering Polymers, Wilmington, Dela., with the commercial names of Santoprene and Hytrel G-4074, respectively. The thermal expansion coefficients of each of these elastomers at 25° C. and within the range $T_m$ to $T_m$ minus 10° C. are listed in Table 1.

In the nylon-12 based conductive polymeric composition, the particulate conductive filler may comprise carbon black, graphite, metal particles, or a combination of these. Metal particles may include, but are not limited to, nickel particles, silver flakes, or particles of tungsten, molybdenum, gold platinum, iron, aluminum, copper, tantalum, zinc, cobalt, chromium, lead, titanium, or tin alloys. Such metal fillers for use in conductive polymeric compositions are known in the art.

It has been discovered herein that when the polymeric composition includes nylon-11, the preferred particulate conductive filler is carbon-based, such as carbon black or graphite, or mixtures of these. The use of such a carbon-based filler provides a nylon-11 composition that exhibits a $T_S$ greater than 150° C., including about 155° C., and preferably between about 160° C. and 200° C., described herein.

Preferably, the conductive particles comprise a highly conductive carbon black, such as Sterling SO N550, Vulcan XC72, and Black Pearl 700 (all available from Cabot Corporation, Norcross, Ga.), all known in the art for their use in conductive polymeric compositions. A suitable carbon black, such as Sterling SO N550, has a particle size of about 0.05–0.08 microns, and a typical particle aggregate sphere size of 0.25–0.5 microns as determined by DiButyl Phthalate (DBP) absorption. The volume ratio of the particulate conductive filler to the polymer component ranges from 10:90 to 70:30, preferably 20:80 to 60:40, and more preferably 30:70 to 50:50, and most preferably 35:65 to 45:55.

In addition to the semicrystalline polymer component and the particulate conductive filler, the conductive polymeric composition may additionally comprise additives to enhance electrical and thermal stability. Suitable inorganic additives include metal oxides, such as magnesium oxide, zinc oxide, aluminum oxide, titanium oxide, or other materials, such as calcium carbonate, magnesium carbonate, alumina trihydrate, and magnesium hydroxide. Such inorganic additives may be present in the composition in an amount by weight of 1% to 10%, and more preferably from 2% to 8%. Organic antioxidants, preferably those having a melting point below, and a flash point above, the temperature at which the conductive polymeric composition is processed, may be added to the composition to increase the thermal stability. Examples of such antioxidants include, but are not limited to, phenol or aromatic amine type heat stabilizers, such as N,N'-1,6-hexanediylbis(3,5-bis(1,1-dimethylethyl)-4-hydroxy-benzene) propanamide (Irganox-1098, Ciba Specialty Chemicals Corp., Tarrytown, N.Y.), N-stearoyl-4-aminophenol and N-lauroyl-4-aminophenol. The proportion by weight of the organic antioxidant agent in the composition may range from 0.1% to 10%. The conductive polymeric composition may also comprise other inert fillers, nucleating agents, antiozonants, fire retardants, stabilizers, dispersing agents, crosslinking agents or other components.

To enhance electrical stability, particularly if the conductive polymer composition is to be employed in a PTC device that is manufactured by compression molding, the conductive polymer composition may be crosslinked by chemicals, such as organic peroxide compounds, or by irradiation, such as by high energy electrons, ultraviolet radiation or by gamma radiation, as known in the art. Although crosslinking is dependent on the polymeric components and the application, normal crosslinking levels are equivalent to that achieved by an irradiation dose in the range of 1 to 50 Mrads, preferably 2 to 30 Mrads, e.g. 10 Mrads. If crosslinking is by irradiation, the composition may be crosslinked before or after attachment of the electrodes.

In an embodiment of the invention, the high temperature PTC device of the invention comprises a PTC "chip" 1 illustrated in FIG. 1 and electrical terminals 12 and 14, as described below and schematically illustrated in FIG. 2. As shown in FIG. 1, the PTC chip 1 comprises the conductive polymeric composition 2 of the invention sandwiched between metal electrodes 3. The electrodes 3 and the PTC composition 2 are preferably arranged so that the current flows through the PTC composition over an area LxW of the chip 1 that has a thickness, T, such that W/T is at least 2, preferably at least 5, especially at least 10. The electrical resistance of the chip or PTC device also depends on the thickness and the dimensions W and L, and T may be varied in order to achieve a preferable resistance, described below. For example, a typical PTC chip generally has a thickness of 0.05 to 5 millimeters (mm), preferably 0.1 to 2.0 mm, and more preferably 0.2 to 1.0 mm. The general shape of the chip/device may be that of the illustrated embodiment or may be of any shape with dimensions that achieve the preferred resistance.

It is generally preferred to use two planar electrodes of the same area which are placed opposite to each other on either side of a flat PTC polymeric composition of constant thickness. The material for the electrodes is not specially limited, and can be selected from silver, copper, nickel, aluminum, gold, and the like. The material can also be selected from combinations of these metals, e.g. nickel-plated copper, tin-plated copper, and the like. The terminals are preferably used in a sheet form. The thickness of the sheet is generally less than 1 mm, preferably less than 0.5 mm, and more preferably less than 0.1 mm.

Figure 2:
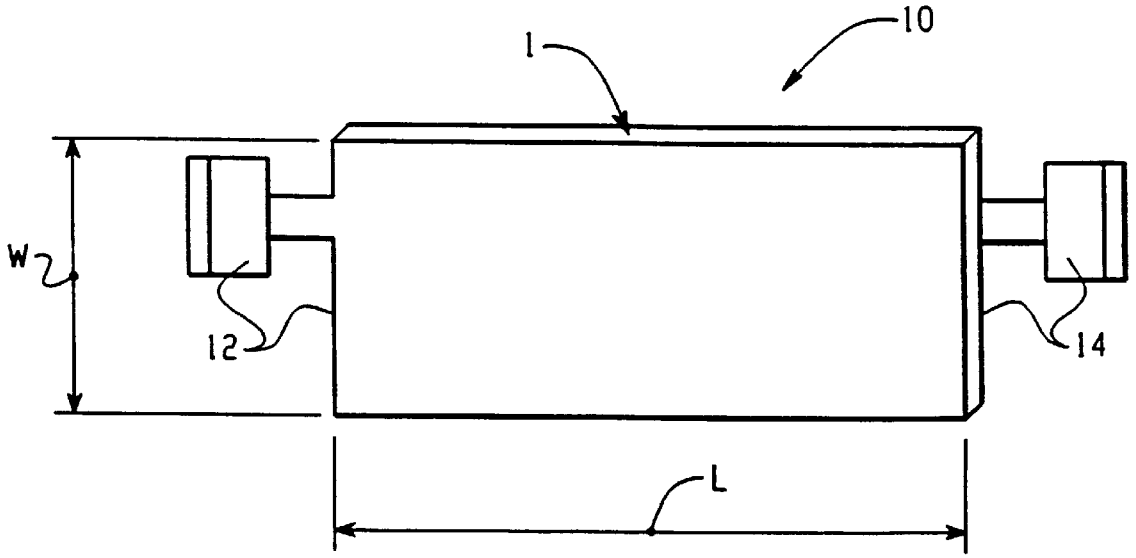
FIG. 2 is a schematic illustration of an embodiment of a PTC device according to the invention, comprising the PTC chip of FIG. 1 with two attached terminals.
Figure 4:
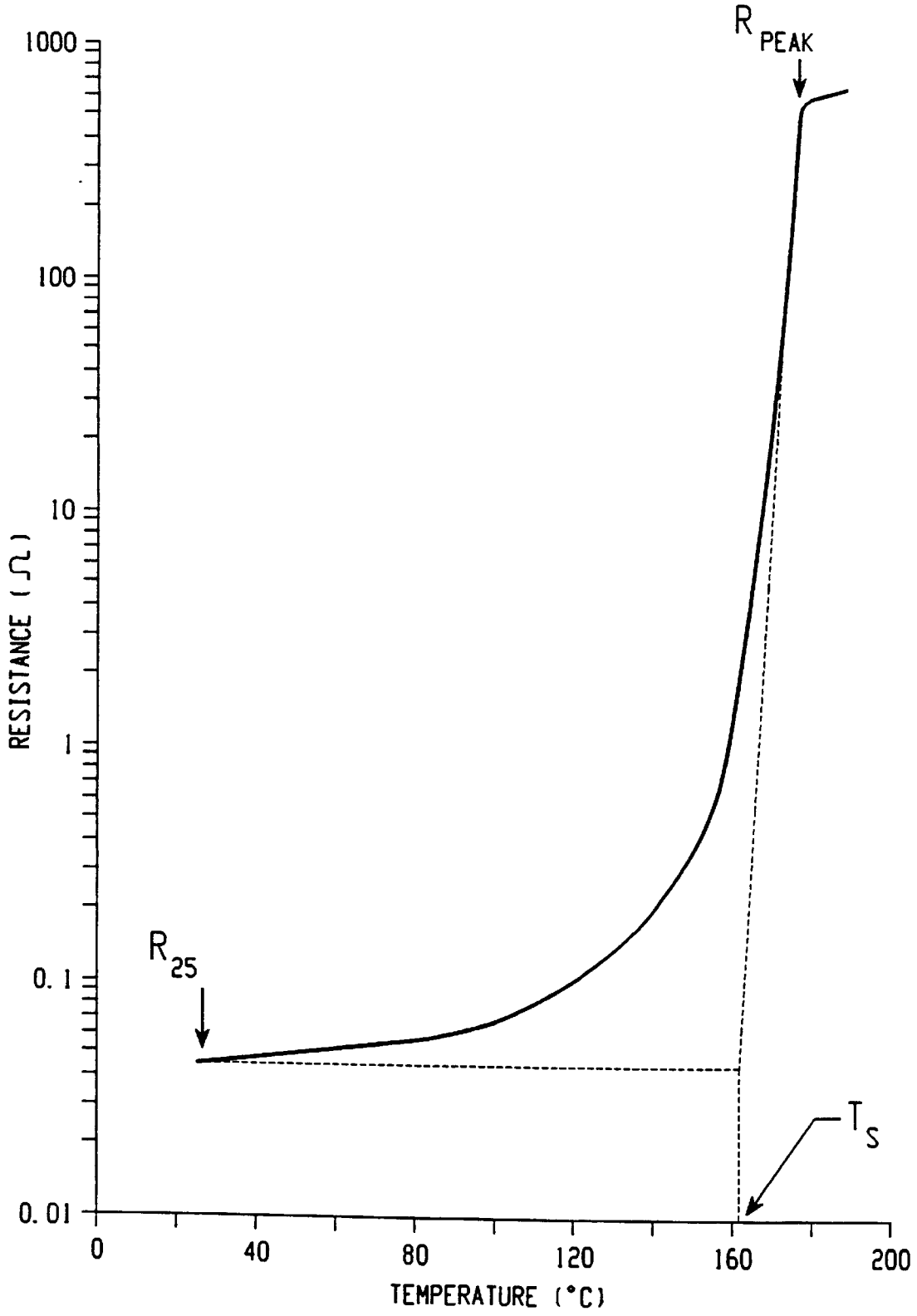
FIG. 4 is a graphic illustration of the PTC behavior of a compression molded device comprising the 35 volume % carbon black composition of Example 4, where $R_{peak}$ is the resistance at the peak of a resistance versus temperature curve and $R_{25}$ is the resistance at 25° C.

An embodiment of the PTC device 10 is illustrated in FIG. 2, with terminals 12 and 14 attached to the PTC chip illustrated in FIG. 1. When an AC or a DC current is passed through the PTC device, the device demonstrates an initial resistance at 25° C. of about 100 mΩ or less, preferably about 80 mΩ or less and more preferably about 60 mΩ or less. The ratio of the peak resistance ($R_{peak}$) of the PTC chip or device to the resistance of the chip/device at 25° C. ($R_{25}$) is at least $10^3$, preferably $10^4$ to $10^5$, where $R_{peak}$ is the resistance at the peak of a resistance versus temperature curve that plots resistance as a function of temperature, as illustrated in FIG. 4. The $T_S$ is shown as the temperature at the intersection point of extensions of the substantially straight portions of a plot of the log of the resistance of the PTC chip/device and the temperature which lies on either side of the portion showing the sharp change in slope.

The high temperature PTC device manufactured by compression molding and containing a crosslinked composition demonstrates electrical stability, showing a resistance $R_{1000}$ and/or $R_{3000}$ at 25° C. that is less than five times, preferably less than three times, and more preferably less than twice, and most preferably less than 1.3 times a resistance $R_0$, where $R_0$ is the initial resistance at 25° C. and $R_{1000}$ and $R_{3000}$ are the resistances at 25° C. after 1000 or 3000 temperature excursions (cycles), respectively, to the $T_S$ and back to 25° C. The electrical stability properties can also be expressed as a ratio of the increase in resistance after "x" temperature excursions to the initial resistance at 25° C., e.g., $[R_{1000}-R_0)/R_0]$. (See, for example, the data of Table 6).

It has been surprisingly discovered herein that high temperature PTC devices manufactured by an extrusion/lamination process demonstrate electrical stability without crosslinking of the composition. Thus, extrusion/laminated devices manufactured of uncrosslinked compositions demonstrate resistances $R_{1000}$ and $R_{3000}$ at 25° C. that are less than five times, preferably less than three times, more preferably less than twice, and most preferably less than 1.3 times the resistance $R_0$ discussed above. However, the electrical stability may be further improved by crosslinking. (See, for example, the data of Tables 12, 13, 14 and 15).

For a single cycle, the PTC devices of the invention may also be capable of withstanding a voltage of 100 volts or more without failure. Preferably, the device withstands a voltage of at least 20 volts, more preferably at least 30 volts, and most preferably at least 100 volts without failure.

The conductive polymeric compositions of the invention are prepared by methods known in the art. In general, the polymer or polymer blend, the conductive filler and additives (if appropriate) are compounded at a temperature that is at least 20° C. higher, but less than 120° C. higher, than the melting temperature of the polymer or polymer blend. The compounding temperature is determined by the flow property of the compounds. In general, the higher the filler content (e.g. carbon black), the higher is the temperature used for compounding. After compounding, the homogeneous composition may be obtained in any form, such as pellets. The composition is then compression molded or extruded into a thin PTC sheet to which metal electrodes are laminated.

To manufacture the PTC sheet by compression molding, homogeneous pellets of the PTC composition are placed in a molder and covered with metal foil (electrodes) on top and bottom. The composition and metal foil sandwich is then laminated into a PTC sheet under pressure. The compression molding processing parameters are variable and depend upon the PTC composition. For example, the higher the filler (e.g., carbon black) content, the higher is the processing temperature and/or the higher is the pressure used and/or the longer is the processing time. Compositions such as those described below in the Examples that contain nylon-12, nylon-11, carbon black, magnesium oxide, and the like, in varying proportions, are compression molded at a pressure of 1 to 10 MPa, typically 2 to 4 MPa, with a processing time of 5 to 60 minutes, typically 10 to 30 minutes. By controlling the parameters of temperature, pressure and time, different sheet materials with various thicknesses may be obtained.

To manufacture a PTC sheet by extrusion, process parameters such as the temperature profile, head pressure, RPM, and the extruder screw design are important in controlling the PTC properties of resulting PTC sheet. Generally, the higher the filler content, the higher is the processing temperature used to maintain a head pressure in the range of 2000–6000 psi with a RPM in the range of 2–20. For example, in extruding 42 volume % carbon black/58 volume % nylon-12 (Aesno-TL) material, a die temperature as high as 280° C. has been employed. A screw with a straight-through design is preferred in the manufacture of PTC sheets. Because this screw design provides low shear force and mechanical energy during the process, the possibility of breaking down the carbon black aggregates is reduced, resulting in PTC sheets having low resistivity. The thickness of the extruded sheets is generally controlled by the die gap and the gap between the laminator rollers. During the extrusion process, metallic electrodes in the form of metal foil covering both the top and bottom of a layer of the polymer compound, are laminated to the composition.

PTC sheets obtained, e.g., by compression molding or extrusion, are then cut to obtain PTC chips having predetermined dimensions and comprising the conductive polymeric composition sandwiched between the metal electrodes. The composition may be crosslinked, such as by irradiation, if desired, prior to cutting of the sheets into PTC chips. Electrical terminals are then soldered to each individual chip to form PTC electrical devices.

A suitable solder provides good bonding between the terminal and the chip at 25° C. and maintains a good bonding at the switching temperature of the device. The bonding is characterized by the shear strength. A shear strength of 250 Kg or more at 25° C. is generally acceptable. The solder is also required to show a good flow property at its melting temperature to homogeneously cover the area of the device dimension. For the high temperature PTC device, the solder used generally has a melting temperature of 10° C., preferably 20° C. above the switching temperature of the device. Examples of solders suitable for use in the invention high temperature PTC devices are 63 Sn/37 Pb (Mp: 183° C.), 96.5 Sn/3.5 Ag (Mp: 221° C.) and 95 Sn/5 Sb (Mp: 240° C.), all available from Lucas-Milhaupt, Inc., Cudahy, Wis.; or 96 Sn/4 Ag (Mp: 230° C.) and 95 Sn/5 Ag (Mp: 245° C.), all available from EFD, Inc., East Providence, R.I.

The following examples illustrate embodiments of the conductive polymeric compositions and high temperature PTC devices of the invention. However, these embodiments are not intended to be limiting, as other methods of preparing the compositions and devices to achieve desired electrical and thermal properties may be determined by those skilled in the art. The compositions, PTC chips and PTC devices were tested for PTC properties directly by a resistance versus temperature (R-T) test and indirectly by a switching test, overvoltage test and cycle test, as described below. The number of samples tested from each batch of chips is indicated below and the results of the testing reported in the Tables are an average of the values for the samples.

The resistances of the PTC chips and devices were measured, using a four-wire standard method, with a Keithley 580 micro-ohmmeter (Keithley Instruments, Cleveland, Ohio) having an accuracy of ±0.01 mΩ. To determine an average resistance value at 25° C., the resistances of at least 24 chips and devices were measured for each PTC composition. The resistivity was calculated from the measured resistance and the geometric area and thickness of the chip.

To determine the resistance/resistivity behavior of the PTC devices versus the temperature (R-T test), three to four device samples were immersed in an oil bath having a constant heating rate of about 2° C. per minute. The temperature and the resistance/resistivity of each of the samples were measured simultaneously. Resistance and temperature were measured with a multimeter having an accuracy of ±0.1 mΩ and an RTD digital thermometer having an accuracy of ±0.01° C., respectively. The PTC effect was calculated by the value of $R_{peak}/R_{25}$.

The $T_S$ of the PTC composition comprising the PTC devices was determined by a constant voltage switching test, usually conducted by passage of a DC current through the device at, for example, 10 volts and 10 amperes (amps). Because of the self-heating caused by the high current, the device quickly reaches the $T_S$ and, with the voltage remaining constant, the current suddenly drops to a low value (OFF Current or trickle current) which can be used to determine the OFF state resistance of the device. The devices exhibit the desired PTC effect if they are capable of staying and stabilizing at the $T_S$ for at least 150 seconds at the specified condition (e.g. 10 volts and 10 amps). During this test, a computer automatically records the initial voltage, initial current, OFF current, the switching temperature and the switching time. The devices that "pass" the initial 10 volt/10 amps test are then subjected sequentially to switching tests at higher voltages, e.g. 15 volts/10 amps, 20 volts/10 amps, 30 volts/10 amps, 50 volts/10 amps, etc., until the device fails. Failure of the device is indicated if the device is incapable of stabilizing at the $T_S$ for 150 seconds or undergoes "thermal runaway". A sample size of three to four was used for this test.

The cycle test is performed in a manner similar to the switching test, except that the switching parameters (usually 10.5 volts and 15 amps or 10.5 volts and 25 amps) remain constant during a specified number of switching cycle excursions from 25° C. to the $T_S$ and back to 25° C. The resistance of the device is measured at 25° C. before and after specified cycles and the number of total cycles may be up to 1000, 2000, 3000 or more. The initial resistance at 25° C. is designated $R_o$ and the resistance after X numbers of cycles is designated $R_x$, e.g. $R_{1000}$. The cycle test sample size was generally five.

The overvoltage test was generally performed on eight device samples using a variable voltage source to test the maximum voltage that the PTC device can withstand. The maximum withstood voltage is determined when a knee point ("knee voltage") appears in a power versus voltage curve. There is a relation between the PTC effect and the knee voltage as shown below:

$$S=kV_k/P_0R$$

where S denotes the PTC effect, R denotes the device resistance at 25° C. (Ω), $V_k$ is the knee voltage of the device (volts), $P_0$ is the power dissipated of the device in the tripped state (watts), and k is the device constant. From the equation, assuming $P_0$ is a constant (about 2.5 watts for the Nylon-12 or Nylon-11 based PTC materials), it can be concluded that the device having a higher PTC effect generally shows a higher value of the knee voltage.

PREPARATION OF NYLON-12/CARBON BLACK AND NYLON-11/CARBON BLACK COMPOSITIONS

Examples 1–6

Nylon-12/carbon black compositions containing various volume percentages of nylon-12 and carbon black are illustrated in Table 2 as examples 1–6. The compositions of each of the examples were generally prepared according to the method described below for preparing the 35 volume % carbon black/65 volume % nylon-12 composition. Variations from the described method for each example are illustrated in the Table. Examples 1–6 contain volume ratios of nylon-12 (Aesno-TL) to carbon black of 80:20 (20 volume %), 75:25 (25 volume %), 70:30 (30 volume %), 65:35 (35 volume %), 60:40 (40 volume %) and 55:45 (45 volume %).

Preparation of the 35 volume % Carbon Black/65 volume % Nylon-12 Composition

To 197 parts by weight of nylon-12 (Aesno-TL) were added 172 parts by weight of carbon black (Sterling SO N550) and 13 parts by weight of magnesium oxide (Aldrich Chemical Co.). The corresponding volume fraction of nylon-12 to carbon black is 65/35, calculated by using a value for the compact density of the carbon black of 1.64 g/cm$^3$ and for the density of the Aesno-TL of 1.01 g/cm$^3$. After slight mechanical stirring, the crude mixture was mixed to homogeneity in a Brabender prep-mill mixer at a temperature of 202° C.–205° C. After 30 minutes of compounding (15 minutes of mixing and 15 minutes of milling), the homogeneous mixture was then cooled and chopped into pellets.

The pelleted nylon-12/carbon black mixture was covered on both top and bottom layers with nickel-plated copper foil electrodes and compression molded at 3 MPa and 205° C. for 20 minutes. The thickness of the resulting molded sheet was typically about 0.4 mm to 0.5 mm. Chip samples of 2×1.1 cm$^2$ were cut from the sheets. Copper terminals were then soldered to each of the chip samples using the 63 Sn/37 Pb solder at a soldering temperature of 215° C. to form PTC devices. The composition was not crosslinked.

Composition Evaluations, Examples 1–6

Figure 3:
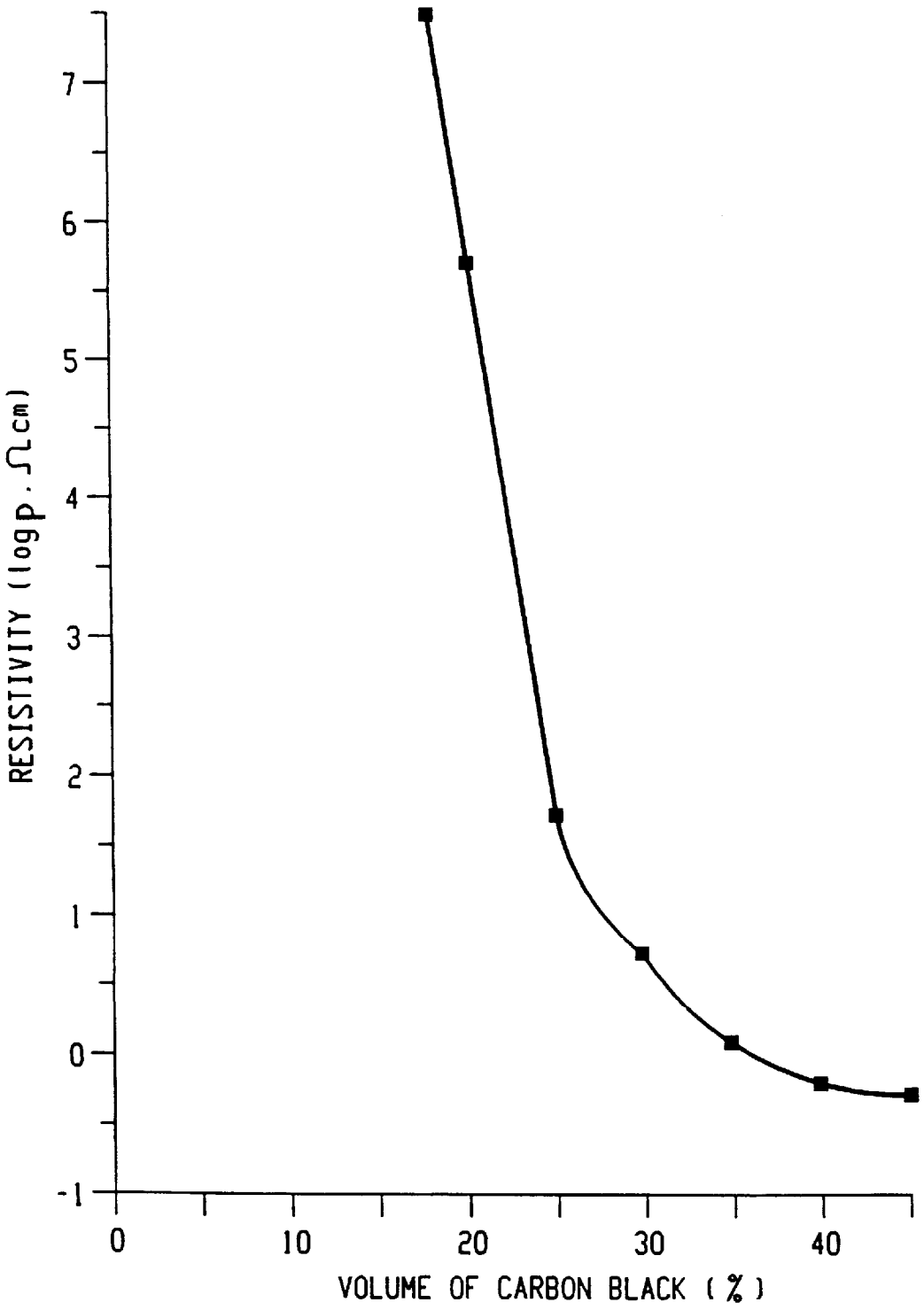
FIG. 3 is a graphic illustration of the resistivity of the PTC compositions of Examples 1–6, comprising nylon-12 and volume percentages of carbon black ranging from 20%–45%.

The resistivity at 25° C. of the PTC chips comprising the conductive nylon-12 compositions of Examples 1–6 was measured and are shown in Table 2 and graphically as a logarithmic plot in FIG. 3. The data show that compositions containing 25% to 45% carbon black by volume (75% to 55% nylon-12 by volume) exhibit an initial resistivity at 25° C. of less than 100 Ωcm and that compositions containing 30% to 45% carbon black by volume exhibit preferred initial resistivities of less than 10 Ωcm. The average resistance of the chips and devices at 25° C. was also measured and devices comprising a composition containing 35% to 45% carbon black by volume exhibit preferred initial resistances of less than 80 mΩ and more preferred resistances of less than 60 mΩ. For examples chips with the 35 volume % carbon black composition showed a resistance of 28.9 mΩ. When copper terminals were soldered to these chips to form PTC devices, the resistance of the devices at 25° C. increased to 59.3 mΩ.

Examples 7–10

The compositions of examples 7–10 illustrated in Table 3 were prepared by compression molding according to the method for examples 1–6 except that the nylon-12 was Grilamid L20G. Examples 7–10 contain volume ratios of nylon-12 to carbon black of 70:30 (30 volume %), 67.5:32.5 (32.5 volume %), 65:35 (35 volume %) and 62:38 (38 volume %).

As shown in Table 3, the average chip resistivity at 25° C. for each of the compositions comprising Grilamid L20G was comparable to that of chips comprising the 30 to 40 volume % compositions of examples 1–6, and each exhibited a preferred resistivity value of less than 10 Ωcm. The average chip resistance of the 30 and 32.5 volume % compositions, however, was high and could lead to a device resistance that would fall outside the preferred range. Therefore, these compositions were not tested further. When terminals were attached to chips comprising the 35 and 38 volume % compositions to form PTC devices, the average resistance of the devices at 25° C. fell within the preferred range. But only devices made from 35 volume % composition were capable of withstanding an average of 47 volts (knee voltage) during the overvoltage test without failure and were also capable of sustaining a $T_S$ for at least 150 seconds under an applied voltage of 30 volts and a current of 10 amps during the switching test, showing a high PTC effect.

Figure 5:
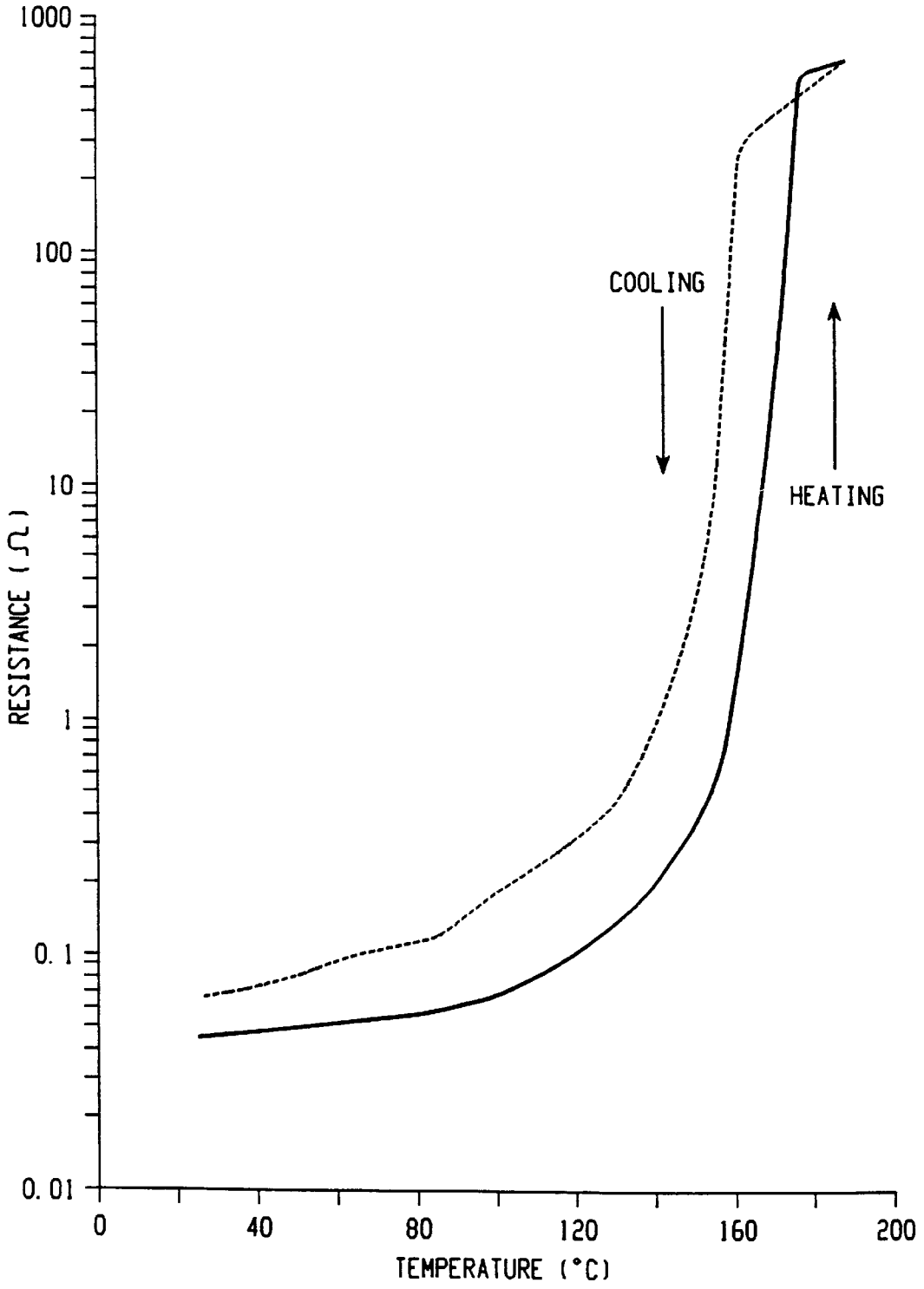
FIG. 5 is a graphic illustration of the switching test results for the PTC device comprising the uncrosslinked composition of Example 4 plotted as a resistance versus temperature curve.

Chips comprising the 35 volume % carbon black/65 volume % nylon-12 composition of example 4 were selected for further testing. The PTC effect of the uncrosslinked composition was determined directly by an R-T test (FIGS. 4 and 5). As illustrated, the $T_S$ of the composition is 161.3° C. and shows a PTC effect of $1.58\times10^4$. The reversibility of the PTC effect is illustrated, although the level of the resistance at 25° C. does not return to the initial level. As discussed below, cross-linking of the composition improved this "ratcheting" effect.

Because of the demonstrated high PTC effect of the composition of example 4, a device comprising the composition can withstand a voltage of as high as 50 volts and a current of as high as 35 amps during the switching test and the overvoltage test reported in Tables 4 and 6. The device demonstrates an average resistance of 59.3 mΩ at 25° C.

TABLE 2

Properties of Nylon-12 (Aesno-TL) Compositions Containing Various Volumes % of Carbon Black

| Example No. | 1 | 2 | 3 | 4 | 5 | 6 |
|---|---|---|---|---|---|---|
| Volume % Carbon Black | 20 | 25 | 30 | 35 | 40 | 45 |
| Weight % Carbon Black | 28.9 | 35.2 | 41.0 | 46.6 | 52.0 | 57.0 |
| Carbon Black* (Sterling N550) | 98.4 | 123.0 | 147.6 | 172.2 | 196.8 | 221.4 |
| Nylon-12* (Aesno-TL) | 242.4 | 227.3 | 212.1 | 197.0 | 181.8 | 166.7 |
| Magnesium Oxide* | 12.1 | 12.4 | 12.8 | 13.1 | 13.5 | 13.8 |
| Molding Temperature (° C.) | 195 | 200 | 202 | 205 | 210 | 235 |
| Molding Pressure (MPa) | 2 | 2 | 2.5 | 3 | 3.5 | 3.5 |
| Molding Time (minutes) | 10 | 10 | 15 | 20 | 20 | 20 |
| Resistivity at 25° C. (Ωcm) | $4.44\times10^5$ | 49.9 | 5.25 | 1.25 | 0.664 | 0.280 |
| Average Chip Resistance** at 25° C. (mΩ) | $5.25\times10^6$ | 738 | 124 | 28.9 | 14.7 | 7.82 |

*Parts by Weight.

**Typical dimension is 2 × 1.1 cm$^2$ with thickness of 0.4–0.5 mm.

TABLE 3

Properties of Nylon-12 (Grilamid L-20G) Compositions Containing Various Volumes % of Carbon Black

| Example No. | 7 | 8 | 9 | 10 |
|---|---|---|---|---|
| Volume % Carbon Black | 30 | 32.5 | 35 | 38 |
| Weight % Carbon Black | 41.0 | 43.9 | 46.6 | 49.9 |
| Carbon Black* (Sterling N550) | 98.4 | 106.6 | 114.8 | 124.6 |
| Nylon-12* (Grilamid L20G) | 141.4 | 136.4 | 131.3 | 125.2 |
| Magnesium Oxide* | 8.51 | 8.63 | 8.75 | 8.87 |
| Molding Temperature (° C.) | 200 | 200 | 205 | 220 |
| Molding Pressure (MPa) | 2.5 | 2.5 | 3 | 3 |
| Molding Time(minutes) | 15 | 15 | 20 | 20 |
| Resistivity at 25° C. (Ωcm) | 2.78 | 1.66 | 1.07 | 0.796 |
| Average Chip Resistance at 25° C. (mΩ) | 65.51 | 37.50 | 19.79 | 11.96 |
| Average Device Resistance at 25° C. (mΩ) | ND*** | ND | 35.46 | 15.04 |
| Average Knee Voltage | ND | ND | 47 | 13.5 |
| Maximum Voltage For Switching Test | ND | ND | 30 | 10 |
| PTC Effect | ND | ND | $1.18 \times 10^4$ | $1.35 \times 10^3$ |

*Parts by Weight.
**Typical dimension is 2 × 1.1 $cm^2$ with thickness of 0.4–0.5 mm.
***Not Done.

The data of Table 4 illustrate the results of a switching test performed for the uncrosslinked 35 volume % composition of example 4 for various voltages applied at 25° C. Both the $T_S$ and the ratio of resistances ($R_T/R_O$) increased with the increase of voltage applied. This indicates that, because of the high PTC effect, the material can withstand high voltage. As the voltage was increased to 50 volts, the $R_T/R_O$ increased to 4 orders of magnitude with a stable $T_S$ of 164.5° C. The composition was then tested for switching properties at various ambient temperatures, as illustrated in Table 5. The results demonstrate acceptable switching properties under 25 volts and 10 mps at ambient temperatures ranging from −40° C. to 50° C.

TABLE 4

Switching Test Results for the Uncrosslinked 35 vol % Carbon Black/65 vol % Nylon-12 Composition at 25° C.

| Test No. | Voltage Applied (V) | Current (A) ON | Current (A) OFF | Off Resistance (Ω)* | Ratio of Resistance $(R_T/R_O)$** | $T_S$ (° C.)*** |
|---|---|---|---|---|---|---|
| 1 | 5 | 5 | 0.85 | 5.88 | 113.1 | 149.5 |
| 2 | 10 | 5 | 0.44 | 22.73 | 437.1 | 158.5 |
| 3 | 12.5 | 10 | 0.35 | 35.71 | 686.8 | 159.2 |
| 4 | 15 | 10 | 0.33 | 45.45 | 874.1 | 159.5 |
| 5 | 17.5 | 10 | 0.27 | 64.81 | $1.248 \times 10^3$ | 159.8 |
| 6 | 20 | 10 | 0.23 | 86.96 | $1.672 \times 10^3$ | 160.2 |
| 7 | 30 | 10 | 0.16 | 187.5 | $3.606 \times 10^3$ | 161.1 |
| 8 | 30 | 20 | 0.14 | 214.3 | $4.121 \times 10^3$ | 161.3 |
| 9 | 50 | 10 | 0.09 | 555.6 | $1.068 \times 10^4$ | 164.5 |

TABLE 4-continued

Switching Test Results for the Uncrosslinked 35 vol % Carbon Black/65 vol % Nylon-12 Composition at 25° C.

| Test No. | Voltage Applied (V) | Current (A) ON | Current (A) OFF | Off Resistance (Ω)* | Ratio of Resistance $(R_T/R_O)$** | $T_S$ (° C.)*** |
|---|---|---|---|---|---|---|
| 10 | 50 | 20 | 0.09 | 555.6 | $1.068 \times 10^4$ | 165.2 |
| 11 | 50 | 35 | 0.09 | 625.0 | $1.202 \times 10^4$ | 165.5 |

*Initial Resistance 0.0520.
**$R_T$ denotes the resistance at $T_S$; $R_O$ denotes the initial resistance at 25° C.
***During the switching test, the sample stayed and was stabilized at $T_S$ for at least 150 seconds.

TABLE 5

Switching Properties Versus Testing Temperature for the Uncrosslinked 35 vol % Carbon Black/65 vol % Nylon-12 Composition†

| Test No. | Testing Temperature (° C.) | Off Current (A) | Off Resistance (Ω)* | Ratio of Resistance $(R_T/R_o)$** | $T_S$ (° C.)*** |
|---|---|---|---|---|---|
| 1 | −40 | 0.26 | 96.2 | $2.16 \times 10^3$ | 161.3 |
| 2 | 0 | 0.21 | 119.1 | $2.68 \times 10^3$ | 163.1 |
| 3 | 15 | 0.20 | 125.0 | $2.81 \times 10^3$ | 164.8 |
| 4 | 50 | 0.15 | 166.7 | $3.75 \times 10^3$ | 167.1 |

†The switching test was conducted under 25 volts and 10 amperes.
*Initial Resistance 0.044
**$R_T$ denotes the Off Resistance; R0 denotes the Initial Resistance.
***During the test, the sample stayed and stabilized at $T_S$ for at least 150 seconds.

TABLE 6

Summary of the R-T Test, Overvoltage Test and Cycle Test Results for the 35 Vol % Carbon Black/65 Vol % Nylon-12 Composition Exposed to Different Levels of Irradiation

| Irradiation Level (Mrad) | Average Device Resistance (mΩ) at 25° C. | R-T test* Typical PTC Effect $(R_{peak}/R_{25})$ | Overvoltage Test Average Knee Voltage | PTC Switching Cycle Test** Resistance Increase ratio After 1000 Cycles $[(R_{1000}-R_O)/R_O]$ |
|---|---|---|---|---|
| 0 | 59.3 | $1.58 \times 10^4$ | 51.3 | 4.54 |
| 2.5 | 44.0 | $1.18 \times 10^4$ | 48.9 | 2.71 |
| 5.0 | 38.8 | $8.30 \times 10^3$ | 45.5 | 2.17 |
| 7.5 | 45.5 | $7.47 \times 10^3$ | 38.5 | 1.83 |
| 10.0 | 49.2 | $1.21 \times 10^4$ | 47.3 | 1.10 |

*$R_{peak}$ denotes the resistance of the PTC device at the peak of the R-T curve; $R_{25}$ denotes the resistance of the device at 25° C.
**The switching cycle test was conducted under 10.5 volts and 15 amps. $R_{1000}$ denotes the resistance of the PTC device at 25° C. after 1000 cycles of the switching test; $R_o$ denotes the initial resistance of the device at 25° C.

Examples 11–14

Figure 6:
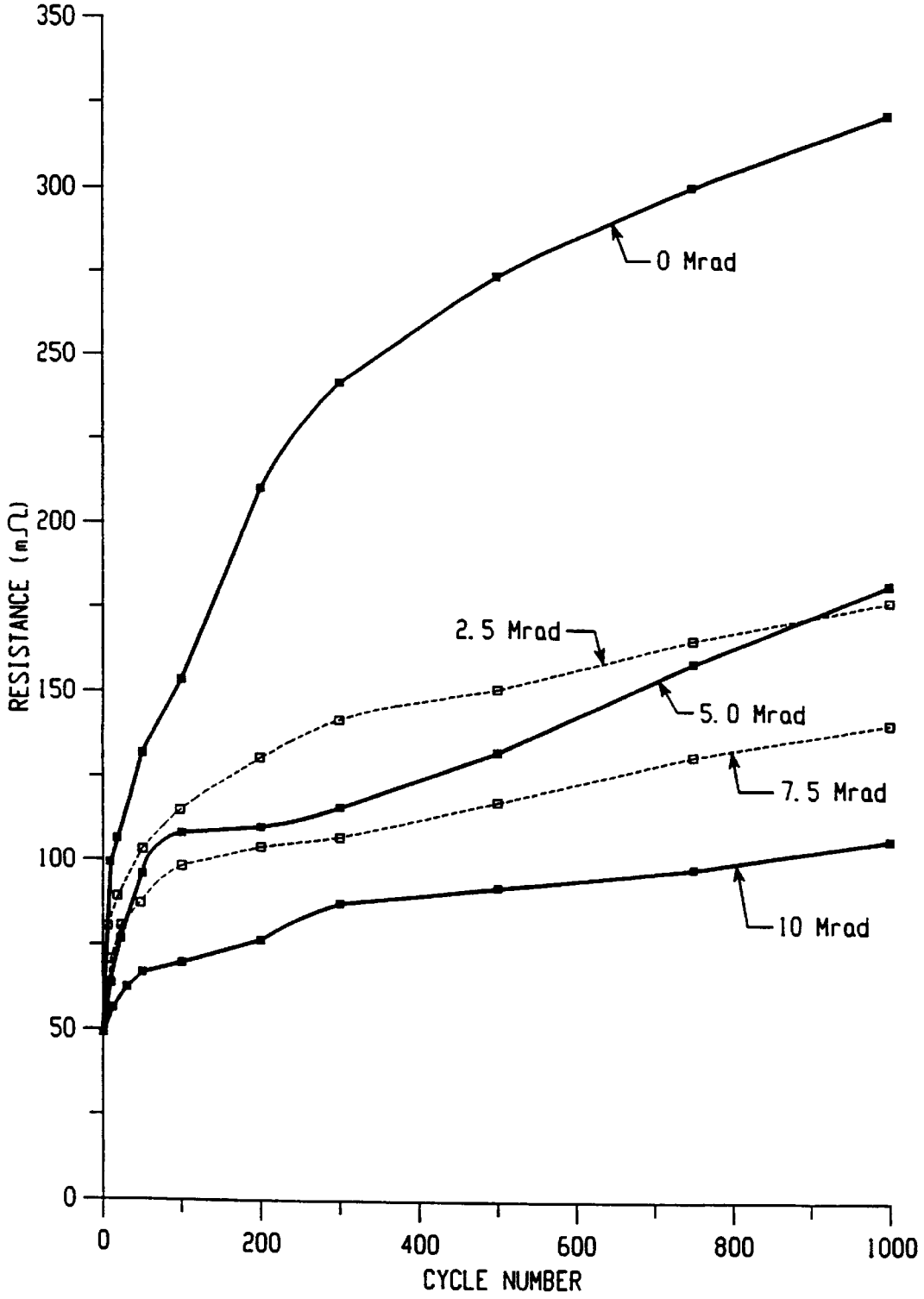
FIG. 6 is a graphic illustration of the effects of various doses of gamma irradiation on the device resistance at 25° C. of the composition of Example 4 (see Examples 11–14) after the indicated number of cycles, where each cycle represents an excursion from 25° C. to the $T_S$ and back to 25° C.
Figure 7:
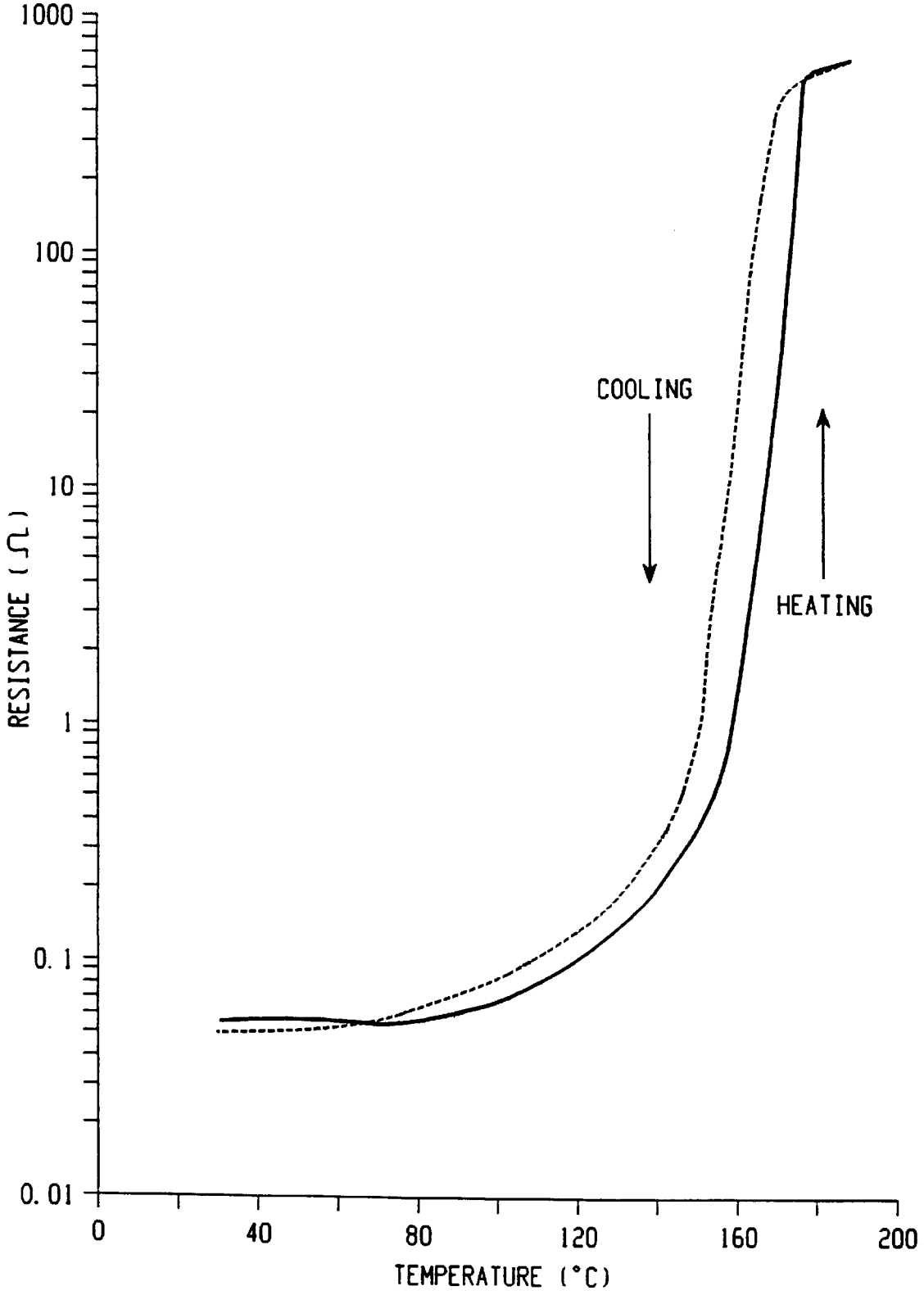
FIG. 7 is a graphic illustration of the switching test results for the PTC device comprising the composition of Example 4 after 10 Mrads of gamma irradiation (see Example 14).

A composition containing 35 volume % carbon black/65 volume % nylon-12 (Aesno-TL) was prepared according to the method of example 4, except that prior to attachment of the terminals, the chips were irradiated with various doses of gamma irradiation from a Cobalt-60 source. Terminals were then attached to the irradiated chips and soldered with the 63 Sn/37 Pb solder, and the resulting PTC devices were subjected to a cycle test comprising 1000 cycles. As illustrated in FIG. 6, an irradiation dose of 2.5, 5, 7.5 or 10 Mrads (examples 11, 12, 13 and 14, respectively) improved the resistance stability at 25° C. of the devices after cycling compared to that of devices of example 4 that were not irradiated. The reversible PTC effect of the composition irradiated with 10 Mrads is illustrated in FIG. 7.

A comparison of the properties of devices prepared according to example 4 (unirradiated) and examples 11–14 (irradiated) are reported in Table 6. It can be seen that after the irradiation, the PTC effect was slightly decreased, but the electrical stability was greatly enhanced, as evidenced by the significantly lowered increase in the electrical resistance of the device at 25° C. after up to 1000 cycles.

Examples 15–18

A composition containing 35 volume % carbon black/65 volume % nylon-12 (Aesno-TL) was prepared according to the method of example 4, except that an antioxidant (Irganox 1098) was added to the composition during compounding. The data of Table 7 illustrate that the addition of the antioxidant did not substantially affect the chip or device resistance at 25° C. However, a small amount of added antioxidant (example 16) substantially increased the PTC effect and the ability of the device to withstand a high voltage (76.7 volts).

TABLE 7

Effects of an Antioxidant on the Properties of Nylon-12 Containing Compositions

| Example No. | 15 | 16 | 17 | 18 |
|---|---|---|---|---|
| Volume Carbon Black | 35% | 35% | 35% | 35% |
| Weight % Carbon Black | 46.6 | 46.6 | 46.6 | 46.6 |
| Carbon Black* (Sterling N550) | 114.8 | 114.8 | 114.8 | 114.8 |
| Nylon-12* (Aesno-TL) | 131.4 | 131.4 | 131.4 | 131.4 |
| Magnesium Oxide* | 8.7 | 8.7 | 8.7 | 8.7 |
| Irganox 1098* | 0 | 1.27 | 4.46 | 7.65 |
| Molding Temperature(° C.) | 205 | 202 | 200 | 200 |
| Molding Pressure (MPa) | 3 | 2.7 | 2.7 | 2.5 |
| Molding Time(minutes) | 20 | 18 | 15 | 15 |
| Average Chip Resistance* at 25° C. (mΩ) | 28.9 | 29.1 | 28.8 | 28.9 |
| Average Device Resistance at 25° C. (mΩ) | 59.3 | 58.9 | 51.8 | 47.5 |
| Average Knee Voltage | 51.3 | 76.7 | 22.0 | 24.8 |
| PTC Effect | $1.58 \times 10^4$ | $2.36 \times 10^4$ | $3.17 \times 10^3$ | $5.27 \times 10^3$ |

*Parts by Weight.
**Typical dimension is 2 × 1.1 $cm^2$ with thickness of 0.4–0.5 mm.

TABLE 8

Properties of Nylon-12 (Vestamid L1940) Compositions Containing Various Volumes % of Carbon Black

| Example No. | 19 | 20 | 21 | 22 | 23 | 24 |
|---|---|---|---|---|---|---|
| Volume % Carbon Black | 32.5% | 35% | 37.5% | 32.5% | 35% | 37.5% |
| Weight % Carbon Black* (Sterling N550) | 106.6 | 114.8 | 123.0 | 106.6 | 114.8 | 123.0 |
| Nylon-12* | 136.4 | 131.3 | 126.3 | 136.4 | 131.3 | 126.3 |
| Magnesium Oxide* | 8.63 | 8.75 | 8.85 | 8.63 | 8.75 | 8.85 |
| Molding Temperature (° C.) | 200 | 205 | 210 | 202 | 205 | 215 |
| Molding Pressure (MPa) | 2.5 | 3 | 3 | 2.5 | 3 | 3 |
| Molding Time (minutes) | 15 | 20 | 20 | 15 | 20 | 20 |
| Resistivity at 25° C. (Ωcm) | 1.691 | 1.124 | 0.879 | 3.058 | 1.341 | 1.022 |
| Average Chip Resistance** at 25° C. (mΩ) | 32.6 | 20.37 | 16.35 | 61.44 | 30.80 | 22.19 |
| Average Device Resistance at 25° C. (mΩ) | 106.9 | 39.53 | 26.15 | 119.4 | 57.73 | 33.93 |
| Average Knee Voltage | 67.8 | 37.0 | 10.0 | 80.9 | 52.1 | 22.7 |

*Parts by Weight. Vestamid L1940 for examples 19–21 and Vestamid L2140 for examples 22–24.
**Typical dimension is 2 × 1.1 $cm^2$ with thickness of 0.4–05 mm.

Examples 19–24

The compositions of examples 19–24 illustrated in Table 8 were prepared according to the method for examples 1–6 except that the nylon-12s were Vestamid L1940 and Vestamid L2140. Examples 19–21 contain volume ratios of Vestamid L1940 to carbon black of 67.5:32.5 (32.5 volume %), 65:35 (35 volume %) and 62.5:37.5 (37.5 volume %). Examples 22–24 contain volume ratios of Vestamid L2140 to carbon black of 67.5:32.5 (32.5 volume %), 65:35 (35 volume %) and 62.5:37.5 (37.5 volume %). Only the 35 volume % compositions showed the resistivity, device resistance and knee voltage in the preferred range.

Examples 25–28

Table 9 illustrates the compositions of examples 25–28 which were prepared according to the method for examples 1–6 except that the polymer composition comprised a polymer blend containing Nylon-12 (Aesno-TL) and polyester-based thermoplastic elastomer (Hytrel-G4074). Examples 25–28 contain a volume ratio of the polymer component to carbon black of 65:35 (35 volume %), and volume ratios of the Hytrel-G4074 to the Aesno-TL of 2:98, 5:95, 9:91 and 14:86, respectively, calculated by using the density values of Hytrel-G4074 of 1.18 g/$cm^3$ and Aesno-TL of 1.01 g/$cm^3$. As shown in Table 9, when the ratio of Hytrel-G4074 in the polymer composition increased, both the device resistance and the knee voltage value decreased although the resistivity of materials only showed a small variation.

Examples 29–32

Compositions containing 36 volume % carbon black/64% volume % nylon-12 (Aesno-TL) (example 29), 38 volume % carbon black/62 volume % nylon-12 (Aesno-TL) (example 30), 40 volume % carbon black/60 volume % nylon-12 (Aesno-TL) (example 31), and 42 volume % carbon black/58 volume % nylon-12 (Aesno-TL) (example 32) were prepared according to the method of example 4, using the compression molding process, and compared with the 35 volume % carbon black/65 volume % nylon-12 (Aesno-TL) composition of example 15. The data of Table 10 illustrate that the increase in the carbon black ratio in the composition lowered both the chip and the device resistance as well as the PTC effect, as evidenced by the low knee voltage value.

TABLE 9

Properties of a Polymer Composition Containing Nylon-12 and a Polyester-Based Thermoplastic Elastomer and Carbon Black

| Example No. | 25 | 26 | 27 | 28 |
|---|---|---|---|---|
| Volume % Carbon Black | 35% | 35% | 35% | 35% |
| Volume % Hytrel-G4074/Blend | 2% | 5% | 9% | 14% |
| Carbon Black* (Sterling N550) | 114.8 | 114.8 | 114.8 | 114.8 |
| Aesno-TL* | 128.7 | 124.7 | 119.5 | 112.9 |
| Hytrel-G4074* | 3.1 | 7.7 | 13.8 | 21.5 |
| Magnesium Oxide* | 8.8 | 8.8 | 8.8 | 8.9 |
| Molding Temperature(° C.) | 205 | 200 | 190 | 190 |
| Molding Pressure (MPa) | 3 | 3 | 2.5 | 2.5 |
| Molding Time(minutes) | 15 | 15 | 15 | 15 |
| Resistivity at 25° C. (Ωcm) | 1.198 | 1.140 | 1.083 | 1.031 |
| Average Chip Resistance** at 25° C. (mΩ) | 27.93 | 26.46 | 25.29 | 24.25 |
| Average Device at 25° C. (mΩ) | 55.29 | 48.49 | 37.05 | 35.19 |
| Average Knee Voltage | 38.5 | 29.2 | 18.1 | 15.0 |

*Parts by Weight.
**Typical dimension is 2 × 1.1 $cm^2$ with thickness of 0.4–0.5 mm.

TABLE 10

Comparison of Properties of Aesno-TL Compositions Having Different Levels of Carbon Black

| Example No. | 15 | 29 | 30 | 31 | 32 |
|---|---|---|---|---|---|
| Volume % Carbon Black | 35% | 36% | 38% | 40% | 42% |
| Carbon Black* (Sterling N550) | 114.8 | 118.1 | 124.6 | 131.2 | 137.8 |
| Nylon-12* (Aesno-TL) | 131.3 | 129.3 | 125.2 | 121.2 | 117.2 |
| Magnesium Oxide* | 8.74 | 8.78 | 8.89 | 8.96 | 9.05 |
| Molding Temperature(° C.) | 205 | 215 | 225 | 235 | 250 |
| Molding Pressure(MPa) | 3 | 3 | 3.5 | 3.5 | 3.5 |
| Molding Time(minutes) | 20 | 20 | 20 | 20 | 20 |
| Average Chip Resistance** at 25° C. (mΩ) | 28.9 | 26.1 | 18.3 | 14.7 | 10.2 |
| Average Device Resistance at 25° C. (mΩ) | 59.3 | 50.4 | 31.3 | 21.5 | 3.1 |
| Average Knee Voltage | 51.3 | 41.0 | 28.3 | 22.2 | <10 |

*Parts by Weight.
**Typical dimension is 2 × 1.1 $cm^2$ with thickness of 0.4–0.5 mm.

Examples 33–35

Compositions containing 36 volume % carbon black/64 volume % nylon-12 (Grilamid L20G) (example 33), 37 volume % carbon black/63% volume % nylon-12 (Grilamid L20G) (example 34), and 39 volume % carbon black/61 volume % nylon-12 (Grilamid L20G) (example 35) were prepared according to the method of example 4, using the compression molding process, and compared with the 35 volume % carbon black/65 volume % nylon-12 (Grilamid L20G) and 38 volume % carbon black/62 volume % nylon-12 (Grilamid L20G) compositions of examples 9 and 10, respectively. The results were similar to those obtained in examples 29–32. The data are shown in Table 11.

Examples 36–43

Examples 36–39 and 40–43 illustrated in Tables 12 and 13, respectively, were the same compositions as those listed in Tables 10 and 11, prepared according to the method of example 4, except that the laminated materials were obtained by using the extrusion/lamination process, rather than the compression molding process. The compounding materials used for the extrusion/lamination process were produced at a higher mixing temperature (225° C.–230° C.). The width of the laminated materials was typically 5–10 cm (2–4 inches), and the thickness was controlled by the die gap and the gap of the laminator rollers. Because of a more homogeneous structure, the materials produced by the extrusion/lamination process generally exhibited higher chip resistance and, therefore, higher device resistance, but had a higher PTC effect and knee voltage value, than the same formulations processed by the compression molding (Tables 10 and 11). The devices of examples 39 and 43 comprising compositions of 42 volume % carbon black/58 volume % Nylon-12 (Aesno-TL) and 39 volume % carbon black/61 volume % Nylon-12 (Grilamid L20G), respectively, showed a low device resistance of 24.00 and 18.22 mΩ, and a high knee voltage of 32.71 and 48.42 volts, respectively.

Examples 44–47

Examples 44–45 and 46–47 were the same as examples 38–39 and 42–43, respectively, except that the solder 96.5 Sn/3.5 Ag, rather than 63 Sn/37 Pb, was used for the soldering process to form PTC devices. The results are also shown in Tables 12 and 13, respectively. It is noted that the use of the high temperature solder, 96.5 Sn/3.5 Ag, improved the already good performance of the PTC devices. For example, with the use of the high temperature solder, devices comprising

TABLE 11

Comparison of Properties of Grilamid L20G Based Compositions Having Different Levels of Carbon Black

| Example No. | 9 | 33 | 34 | 10 | 35 |
|---|---|---|---|---|---|
| Volume % Carbon Black | 35% | 36% | 37% | 38% | 39% |
| Carbon Black* (Sterling N550) | 114.8 | 118.1 | 121.4 | 124.6 | 127.9 |
| Nylon-12* (Grilamid L20G) | 131.3 | 129.3 | 127.3 | 125.2 | 123.2 |
| Magnesium Oxide* | 8.74 | 8.78 | 8.83 | 8.89 | 8.91 |
| Molding Temperature(° C.) | 205 | 210 | 215 | 220 | 225 |
| Molding Pressure (MPa) | 3.0 | 3.0 | 3.0 | 3.0 | 3.5 |
| Molding Time(minutes) | 20 | 20 | 20 | 20 | 20 |
| Average Chip Resistance at 25° C. (mΩ) | 19.8 | 17.0 | 14.2 | 12.0 | 9.6 |
| Average Device Resistance at 25° C. (mΩ) | 35.5 | 32.5 | 18.3 | 15.0 | 11.8 |
| Average Knee Voltage | 47.0 | 32.8 | 20.2 | 13.5 | <10 |

*Parts by Weight.
**Typical dimension is 2 × 1.1 $cm^2$ with thickness of 0.4–0.5 mm.

TABLE 12

| Extrusion/Lamination Processed Nylon-12 Materials (Aesno-TL) | | | | | | |
|---|---|---|---|---|---|---|
| Example No. | 36 | 37 | 38 | 39 | 44 | 45 |
| Volume % Carbon Black | 36% | 38% | 40% | 42% | 40% | 42% |
| Die Temperature (° C.) | 245 | 250 | 270 | 280 | 270 | 280 |
| Average Chip Resistance** at 25° C. (mΩ) | 53.88 | 39.92 | 34.13 | 20.28 | 34.13 | 20.28 |
| Average Device Resistance at 25° C. (mΩ) | 119.41 | 80.21 | 59.58 | 24.00 | 61.50 | 26.12 |
| Average knee Voltage | >100 | >100 | 90.0 | 32.71 | >100 | 60.77 |
| Resistance Increase Ratio After 3000 Cycle Test $[(R_{3000}-R_0)/R_0]$ | ND** | ND | 1.89 | 5.87 | 1.72 | 3.20 |

*Typical dimension is 2 × 1.1 $cm^2$ with thickness of 0.45 mm.
**Not done compositions of 42 volume % carbon black/58 volume % Nylon-12 (Aesno-TL) and 39 volume % carbon black/61 volume % Nylon-12 (Grilamid) demonstrated lower device resistances of 26.12 and 18.59 mΩ, and higher knee voltages of 60.8 and more than 100 volts, respectively.

Examples 48–51

Examples 48–51 were the same as examples 44–47, except that the extruded/laminated materials were irradiated with a dose of 10 Mrads of gamma irradiation from a Cobalt-60 source. As illustrated in Table 14, it was found that after the irradiation process, all the illustrated materials exhibited lower chip resistance and device resistance that those without irradiation treatment. The

TABLE 13

| Extrusion/Lamination Processed Nylon-12 Materials (Grilamid L20G) | | | | | | |
|---|---|---|---|---|---|---|
| Examples | 40 | 41 | 42 | 43 | 46 | 47 |
| Volume % Carbon black | 36% | 37% | 38% | 39% | 38% | 39% |
| Die temperature (° C.) | 235 | 245 | 250 | 255 | 250 | 255 |
| Average chip resistance at 25° C. (mΩ) | 38.77 | 27.04 | 23.30 | 12.02 | 23.30 | 12.02 |
| Average device resistance at 25° C. (mΩ) | 68.37 | 54.71 | 45.04 | 18.22 | 45.55 | 18.59 |
| Average knee voltage | 88.20 | 82.54 | 76.28 | 48.4 | >100 | >100 |
| Resistance increase ratio after 3000 cycle test $[(R_{3000}-R_0)/R_0]$ | ND** | 1.47 | 2.23 | 4.69 | 1.93 | 3.42 |

*Typical dimension is 2 × 1.1 $cm^2$ with thickness of 0.45 mm.
**Not done.

knee voltage values for these materials were also slightly decreased, but the cycle test performance improved.

Examples 52–55

The compositions of Examples 52–55 demonstrated in Table 15 were prepared according to the method for Examples 44–45, using the extrusion/lamination process, except that a higher carbon black content was used. Two different levels of Irganox 1098 and magnesium oxide (MgO) were also used to modify compositions. Thus, the composition of Examples 52–53 was the 43 volume % carbon black/57 volume % nylon-12 (Aesno-TL) with 3 weight % Irganox 1098 and 3.5 weight % MgO; and that of Examples 54–55 was the 44 volume % carbon black/56 volume % nylon-12 (Aesno-TL) with 5 weight % Irganox 1098 and 7 weight % MgO. After the compounding process, both compositions were extruded to produce PTC laminates with two different thickness, of 0.5 mm and 0.7 mm, respectively. After a treatment using 2.5 Mrads of gamma irradiation from a Cobalt-60 source, the PTC chips were soldered with the high temperature solder (96.5 Sn/3.5 Ag) to form PTC devices.

As illustrated in Table 15, these compositions exhibited very high knee voltage values and a device resistance in the preferred range. The cycle test performance was also remarkably improved. For example, the PTC device with the composition of Example 53 showed only a 0.07 (or 7%) increase in the device resistance after 1000 cycles.

TABLE 14

| Extrusion/lamination Processed & Irradiation-Treated (10 Mrads) Nylon-12 Materials | | | | |
|---|---|---|---|---|
| Examples | 48 | 49 | 50 | 51 |
| Nylon-12 | Aesno-TL | | Grilamid L20G | |
| Volume% Carbon black | 40% | 42% | 38% | 39% |
| Average chip resistance at 25° C. (mΩ) | 32.11 | 17.42 | 23.13 | 11.11 |
| Average device resistance at 25° C. (mΩ) | 55.88 | 25.83 | 35.67 | 15.55 |
| Average knee voltage | >100 | 63.0 | >100 | 81.0 |
| Resistance increase ratio after 3000 cycle test $[(R_{3000}-R_O)/R_O]$ | 0.40 | 2.34 | 1.62 | 3.01 |

*Typical dimension is 2 × 1.1 $cm^2$ with a thickness of 0.45 mm.
**Not done.

TABLE 15

| Extrusion/lamination Processed & Irradiation-Treated (2.5 Mrads) Nylon-12 Materials | | | | |
|---|---|---|---|---|
| Examples | 52 | 53 | 54 | 55 |
| Volume % Carbon black | 43 | 43 | 44 | 44 |
| Carbon Black* (Sterling N550) | 141.0 | 141.0 | 144.3 | 144.3 |
| Nylon-12* (Aesno-TL) | 115.1 | 115.1 | 113.1 | 113.1 |
| Magnesium Oxide | 9.1 | 9.1 | 18.0 | 18.0 |
| Irgano 1098* | 7.7 | 7.7 | 12.9 | 12.9 |
| Die Temperature (° C.) | 270 | 270 | 280 | 280 |
| Laminate Thickness (mm) | 0.50 | 0.70 | 0.50 | 0.70 |
| Average chip resistance at 25° C. (mΩ) | 18.52 | 34.41 | 20.34 | 28.73 |
| Average device resistance at 25° C. (mΩ)** | 30.88 | 51.95 | 37.67 | 47.15 |
| Average knee voltage | 100.0 | 110.0 | 101.3 | 95.7 |
| Resistance increase ratio after 1000 cycle test $[R_{1000}-R_{O)})/R_O]$ | 0.28 | 0.07 | 0.96 | 0.81 |

*Parts by weight.
**Typical dimension is 2 × 1.1 $cm^2$.

Examples 56–60

Figure 8:
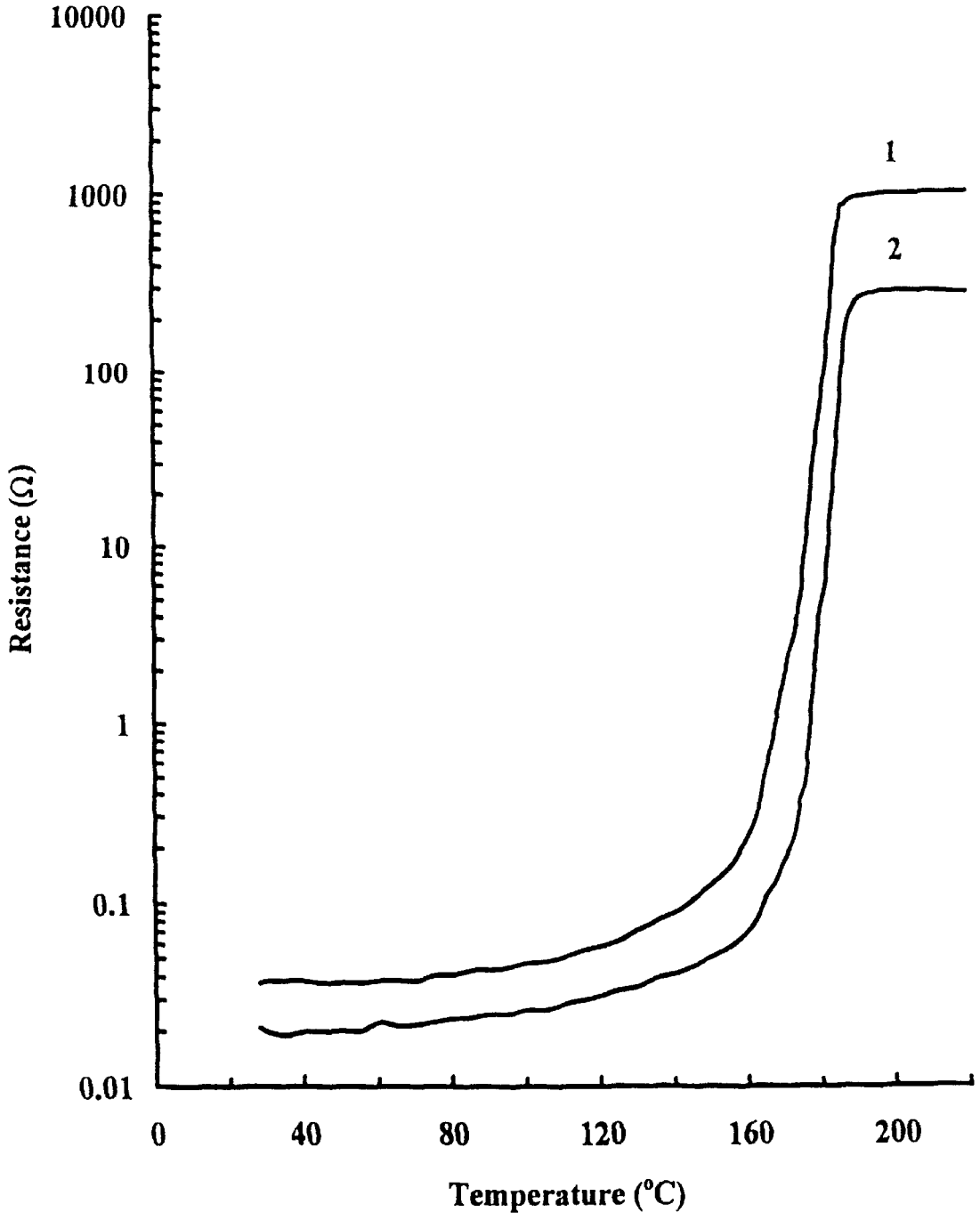
FIG. 8 is a graphic illustration of the PTC behavior of compression-molded devices comprising the (1) 37.5 volume %/Nylon-11, and (2) 40 volume % carbon black/Nylon-11 compositions of Examples 58 and 59.

Compositions containing Nylon-11 (Besno-TL) were prepared according to the method of Example 4, using the prep-mill mixing and compression molding processes, except that a higher compounding temperature of 230–235° C. was used. The volume percentages of carbon black and the testing results are illustrated in Table 16. The devices produced from Nylon-11/carbon black compositions show properties similar to devices produced with Nylon-12 (Aesno-TL). An increase in the volume percent of carbon black in the composition produced a decrease in the chip and device resistance, as well as a decreased PTC effect evidenced by a decrease in the knee voltage value. Only devices made with 37.5 volume % and 40 volume % carbon black compositions had both a lower device resistance and a higher knee voltage value which were within the preferred range. As noted previously, when the high temperature solder (96.5 Sn/3.5 Ag) was used for the device, the device resistance was slightly increased but the PTC performance demonstrated by the knee voltage was greatly improved. Further evaluation of the Nylon-11 (Besno-TL) devices indicated that the materials had a switching temperature of about 171° C.–181° C., depending upon the composition used and the testing voltage applied (Table 17), and a PTC effect of $2.38\times10^4$ and $9.62\times10^3$ for 37.5 volume % and 40 volume % carbon black compositions, respectively (FIG. 8).

While the invention has been described herein with reference to the preferred embodiments, it is to be understood that it is not intended to limit the invention to the specific forms disclosed. On the contrary, it is intended to cover all modifications and alternative forms falling within the spirit and scope of the invention.

TABLE 16

Properties of Nylon-11 Compositions Containing Various Volumes % of Carbon Black

| Example No. | 56 | 57 | 58 | 59 | 60 |
|---|---|---|---|---|---|
| Volume % Carbon Black | 32.5% | 35% | 37.5% | 40% | 42% |
| Carbon Black* (Sterling N550) | 106.6 | 114.8 | 123.0 | 131.2 | 137.8 |
| Nylon-11* (Besno-TL) | 136.4 | 131.3 | 126.3 | 121.2 | 117.2 |
| Magnesium Oxide* | 8.63 | 8.74 | 8.85 | 8.96 | 9.05 |
| Molding Temperature(° C.) | 215 | 225 | 240 | 255 | 265 |
| Molding Pressure (MPa) | 3.0 | 3.0 | 3.5 | 3.5 | 3.5 |
| Molding Time(minutes) | 15 | 15 | 15 | 15 | 15 |
| Average Chip Resistance** at 25° C. (mΩ) | 77.37 | 45.40 | 19.51 | 14.61 | 11.27 |
| Average Device Resistance*** at 25° C. (mΩ) | 701.8 | 149.0 | 31.53 | 20.24 | 15.01 |
| Average Knee Voltage*** | >100 | >100 | 45.8 | 19.5 | <10 |
| Average Device Resistance**** at 25° C. (mΩ) | 2120 | 210.3 | 33.04 | 21.40 | 16.42 |
| Average Knee Voltage**** | >100 | >100 | 80.0 | 34.1 | <10 |

*Parts by Weight.
**Typical dimension is 2 × 1.1 $cm^2$ with thickness of 0.6–0.7 mm.
***With 63Sn/37Pb solder.
****With 96.5Sn/3.5Ag solder.

TABLE 17

Switching Test Results for Nylon-11 PTC* Devices at 25° C.

| Test No. | PTC Device Composition | Voltage Applied (V) | Current (A) On | Current (A) Off | Resistance (Ω) On ($R_O$) | Resistance (Ω) Off ($R_T$)** | Ratio of Resistance ($R_T/R_O$)** | $T_S$ (° C.) |
|---|---|---|---|---|---|---|---|---|
| 1 | 37.5 vol % | 10.5 | 10 | 0.38 | 0.030 | 27.63 | 921.0 | 171.4 |
| 2 | 37.5 vol % | 16 | 10 | 0.24 | 0.032 | 66.67 | $2.083 \times 10^3$ | 174.6 |
| 3 | 37.5 vol % | 20 | 10 | 0.18 | 0.029 | 111.1 | $3.831 \times 10^3$ | 175.9 |
| 4 | 37.5 vol % | 30 | 10 | 0.14 | 0.033 | 214.3 | $6.494 \times 10^3$ | 177.2 |
| 5 | 37.5 vol % | 40 | 10 | 0.11 | 0.031 | 363.6 | $1.173 \times 10^4$ | 178.1 |
| 6 | 37.5 vol % | 50 | 10 | 0.10 | 0.029 | 500 | $1.724 \times 10^4$ | 179.0 |
| 7 | 40 vol % | 10.5 | 10 | 0.4 | 0.021 | 26.25 | $1.250 \times 10^3$ | 176.0 |
| 8 | 40 vol % | 16 | 10 | 0.28 | 0.021 | 57.17 | $2.721 \times 10^3$ | 178.5 |
| 9 | 40 vol % | 20 | 10 | 0.21 | 0.023 | 95.24 | $4.141 \times 10^3$ | 179.0 |
| 10 | 40 vol % | 25 | 10 | 0.17 | 0.022 | 147.1 | $6.686 \times 10^3$ | 179.9 |
| 11 | 40 vol % | 30 | 10 | 0.15 | 0.023 | 200.0 | $8.696 \times 10^3$ | 180.8 |

*96.5 Sn/3.5 Ag solder was used.
**$R_T$ denotes the resistance at Ts; $R_o$ denotes the initial resistance at 25° C.

I claim:

1. An electrically conductive polymeric composition which exhibits PTC behavior, comprising:

(a) a semicrystalline polymer component that includes nylon-11;

(b) a carbon-based particulate conductive filler, wherein the composition has a resistivity at 25° C. of 100 Ωcm or less and a resistivity at a $T_S$ greater than 150° C. that is at least $10^3$ times the resistivity at 25° C.

2. The composition of claim 1, wherein the $T_S$ falls between about 160° C. and about 200° C.

3. The composition of claim 2, wherein the $T_S$ falls between about 165° C. and about 195° C.

4. The composition of claim 3, wherein the $T_S$ falls between about 170° C. and about 190° C.

5. The composition of claim 1, wherein the particulate filler is carbon black or graphite or mixtures thereof.

6. The composition of claim 5, wherein the particulate filler is carbon black.

7. The composition of claim 1, including about 10% to about 70% by volume of the particulate conductive filler.

8. The composition of claim 7, including about 30% to about 50% by volume of the particulate conductive filler.

9. The composition of claim 8, including about 35% to about 45% by volume of the particulate conductive filler.

10. The composition of claim 1, having a resistivity at 25° C. of 10 Ωcm or less.

11. The composition of claim 1, wherein the polymeric composition is crosslinked with the aid of a chemical agent or by irradiation.

12. The composition of claim 11, wherein the polymeric composition is crosslinked by irradiation.

13. The composition of claim 1, further comprising about 0.5% to about 20% by volume of a second semi-crystalline polymer.

14. The composition of claim 13, wherein the second polymer has a melting temperature $T_m$ of about 150° C. to about 190° C.

15. The composition of claim 13, wherein the second polymer has a thermal expansion coefficient value at a temperature in the range of $T_m$ to $T_m$ minus 10° C. that is at least five times greater than the thermal expansion coefficient value at 25° C.

16. The composition of claim 13, wherein the second polymer is selected from a polyolefin-based or a polyester-based thermoplastic elastomer, and mixtures and copolymers thereof.

17. An electrical device which exhibits PTC behavior, comprising:

(a) a conductive polymeric composition that includes nylon-11 and about 10% to about 70% by volume of a carbon-based particulate conductive filler, said composition having a resistivity at 25° C. of 100 Ωcm or less and a resistivity at a $T_S$ greater than 150° C. that is at least $10^3$ times the resistivity at 25° C.; and (b) at least two electrodes which are in electrical contact with the conductive polymeric composition to allow a DC current to pass through the composition under an applied voltage.

18. The device of claim 17, wherein the $T_S$ falls between about 160° C. and about 200° C.

19. The device of claim 18, wherein the $T_S$ falls between about 165° C. and about 195° C.

20. The device of claim 19, wherein the $T_S$ falls between about 170° C. and about 190° C.

21. The device of claim 17, wherein the particulate filler is carbon black or graphite or mixtures thereof.

22. The device of claim 21, wherein the particulate filler is carbon black.

23. The device of claim 17, having a resistance of about 100 mΩ or less than 25° C.

24. The device of claim 23, having a resistance of about 80 mΩ or less at 25° C.

25. The device of claim 24, having a resistance of about 60 mΩ or less at 25° C.

26. The device of claim 17, further comprising an electrical terminal soldered to an electrode by a solder having a melting temperature at least 10° C. above the $T_S$ of the composition.

27. The device of claim 26, wherein the solder has a melting point of about 180° C. or greater.

28. The device of claim 27, wherein the solder has a melting point of about 220° C. or greater.

29. The device of claim 28, wherein the solder has a melting point of about 230° C. or greater.

30. The device of claim 29, wherein the solder has a melting point of about 245° C. or greater.

31. The device of claim 17, wherein the applied voltage is at least 20 volts.

32. The device of claim 31, wherein the applied voltage is at least 30 volts.

33. The device of claim 32, wherein the applied voltage is at least 100 volts.

34. The device of claim 17, wherein the composition further comprises about 0.5% to about 20% by volume of a second semicrystalline polymer.

35. The device of claim 34, wherein the second polymer is selected from a polyolefin-based or a polyester-based thermoplastic elastomer.

36. The device of claim 17, produced by compression molding.

37. The device of claim 36, wherein the polymeric composition is crosslinked with the aid of a chemical agent or by irradiation.

38. The device of claim 37, wherein the polymeric composition is crosslinked by irradiation.

39. The device of claim 37, having an initial resistance $R_o$ at 25° C. and a resistance $R_{1000}$ at 25° C. after 1000 cycles to the $T_S$ and back to 25° C., and $R_{1000}$ is less than five times Ro.

40. The device of claim 39, wherein $R_{1000}$ is less than three times Ro.

41. The device of claim 40, wherein $R_{1000}$ is less than twice Ro.

42. The device of claim 41, wherein $R_{1000}$ is less than 1.3 times Ro.

43. The device of claim 37, having an initial resistance $R_o$ at 25° C. and a resistance $R_{3000}$ at 25° C. after 3000 cycles to the $T_S$ and back to 25° C., and $R_{3000}$ is less than five times Ro.

44. The device of claim 43, wherein $R_{3000}$ is less than three times Ro.

45. The device of claim 44, wherein $R_{3000}$ is less than twice Ro.

46. The device of claim 45, wherein $R_{3000}$ is less than 1.3 times Ro.

47. The device of claim 17, produced by extrusion/lamination.

48. The device of claim 47, having an initial resistance $R_o$ at 25° C. and a resistance $R_{1000}$ at 25° C. after 1000 cycles to the $T_S$ and back to 25° C., and $R_{1000}$ is less than five times Ro.

49. The device of claim 48, wherein $R_{1000}$ is less than three times Ro.

50. The device of claim 49, wherein $R_{1000}$ is less than twice Ro.

51. The device of claim 50, wherein $R_{1000}$ is less than 1.3 times Ro.

52. The device of claim 47, having an initial resistance $R_o$ at 25° C. and a resistance $R_{3000}$ at 25° C. after 3000 cycles to the $T_S$ and back to 25° C., and $R_{3000}$ is less than five times Ro.

53. The device of claim 52, wherein $R_{3000}$ is less than three times Ro.

54. The device of claim 53, wherein $R_{3000}$ is less than twice Ro.

55. The device of claim 54, wherein $R_{3000}$ is less than 1.3 times Ro.-

56. The device of claim 47, wherein the polymeric composition is crosslinked with the aid of a chemical agent or by irradiation.

57. The device of claim 56, wherein the polymeric composition is crosslinked by irradiation.

* * * * *